US007699434B2

(12) United States Patent
Zengo et al.

(10) Patent No.: US 7,699,434 B2
(45) Date of Patent: Apr. 20, 2010

(54) LIQUID DROPLET DISCHARGING DEVICE

(75) Inventors: Takeshi Zengo, Kanagawa (JP); Masahiko Sekimoto, Kanagawa (JP); Toru Nishida, Kanagawa (JP); Satoshi Mohri, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 721 days.

(21) Appl. No.: 11/589,455

(22) Filed: Oct. 30, 2006

(65) Prior Publication Data

US 2007/0268330 A1 Nov. 22, 2007

(30) Foreign Application Priority Data

May 17, 2006 (JP) ..... 2006-137155

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS 6,561,619 B1 * 5/2003 Shibata et al. ..... 347/33
2006/0087530 A1 * 4/2006 Furukawa ..... 347/33

FOREIGN PATENT DOCUMENTS

JP 2001-179953 7/2001

* cited by examiner

*Primary Examiner*—Stephen D Meier
*Assistant Examiner*—Alexander C Witkowski
(74) *Attorney, Agent, or Firm*—Fildes & Outland, P.C.

(57) ABSTRACT

There is provided a liquid droplet discharging device including: a liquid droplet discharging head, for discharging liquid droplets; an opposing member, opposing the liquid droplet discharging head; and a blade, cleaning the opposing member and in contact with the opposing member, a plurality of grooves being formed on the blade, and the grooves having a groove width increasing from a bottom portion thereof to an opening portion thereof, and a groove angle decreasing from the side of the opposing member to the side opposite to the opposing member.

14 Claims, 22 Drawing Sheets

LIQUID DROPLET DISCHARGING DEVICE

BACKGROUND

1. Technical Field

The present invention relates to a liquid droplet discharging device cleaning a member to which a liquid droplet adheres from a liquid droplet discharging head.

2. Related Art

In an ink jet printer as a the liquid droplet discharging device, when a paper jam is generated during printing, an ink droplet is discharged from an ink jet recording head (liquid droplet discharging head) under a state in which there is no paper on a conveying belt (conveying member), and ink adheres to the conveying belt in some cases. Moreover, ink also adheres to the conveying belt when a dummy jet is discharged toward the conveying belt, that is, when ink droplet is discharged to the conveying belt not for printing, but only for preventing an unused nozzle from clogging. Accordingly, the ink jet printer is provided with a cleaning member such as a blade which scrapes off ink adhered to the conveying belt.

SUMMARY

According to an aspect of the present invention, there is provided a liquid droplet discharging device including: a liquid droplet discharging head, for discharging liquid droplets; an opposing member, opposing the liquid droplet discharging head; and a blade, cleaning the opposing member and in contact with the opposing member, a plurality of grooves being formed on the blade, and the grooves having a groove width increasing from a bottom portion thereof to an opening portion thereof, and a groove angle decreasing from the side of the opposing member to the side opposite to the opposing member.

BRIEF DESCRIPTION OF THE DRAWINGS

Exemplary embodiments of the present invention will be described in detail based on the following figures, wherein.

DETAILED DESCRIPTION

Hereinafter, a first exemplary embodiment according to the present invention will be explained, referring to drawings.

Figure 1:
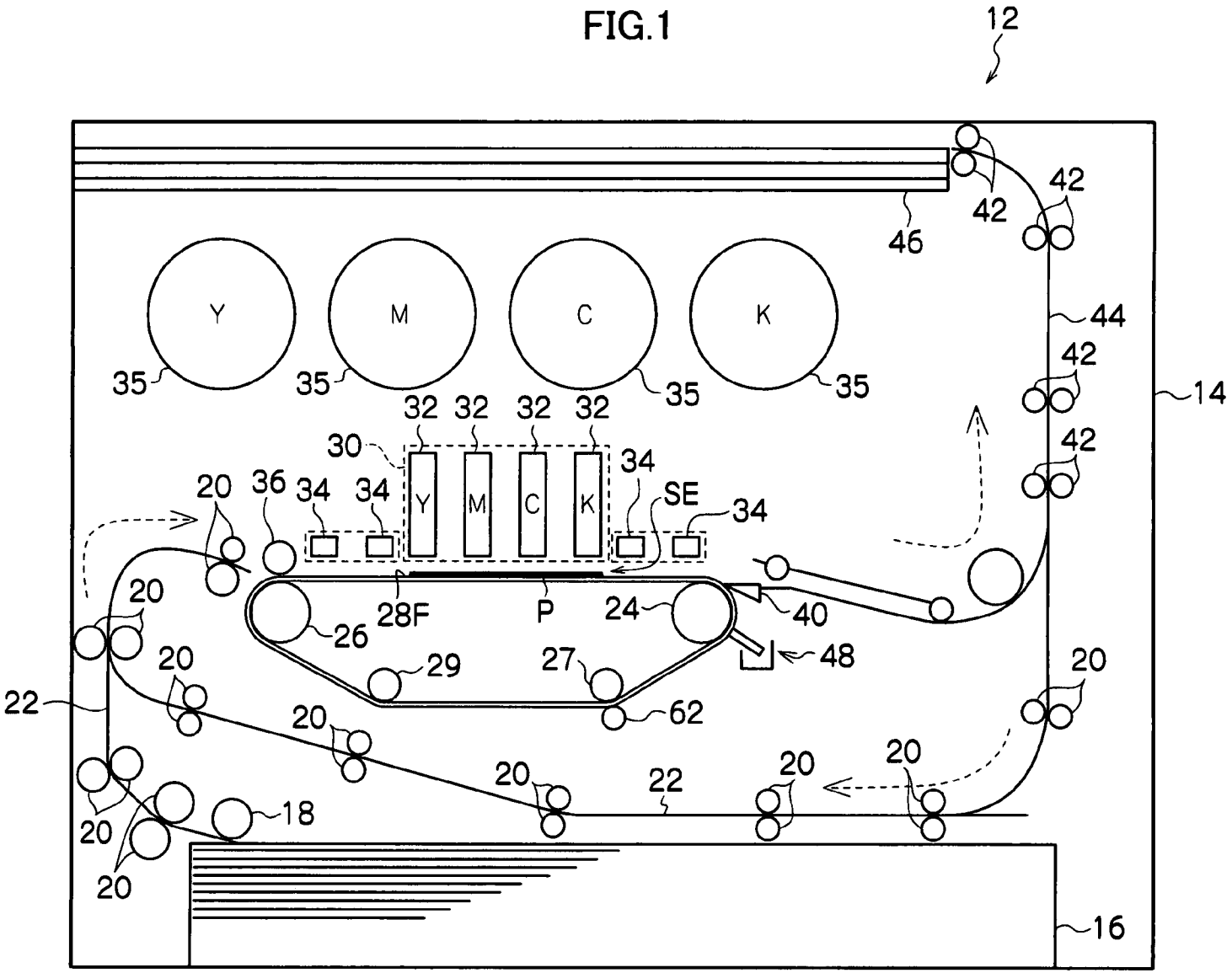
FIG. 1 is a schematic side view showing an ink jet recording device according to a first embodiment of the invention.

FIG. 1 shows an ink jet recording device 12 as a liquid droplet discharging device in the embodiment. A paper feeding tray 16 is provided in the lower portion within a casing 14 of the ink jet recording device 12, and paper P laminated in the paper feeding tray 16 is taken out one by one by a pick-up roller 18. The taken out paper P is conveyed by plural pairs of conveying rollers 20 forming a predetermined conveyance path 22.

In the upper portion of the paper feeding tray 16, an endless conveying belt 28 as a opposing member and a conveying member is stretched and suspended by a driving roller 24 and a driven rollers 26, 27, and 29. The driving roller 24 and the driven roller 26 is disposed in an approximately horizontal manner, and the driven rollers 27 and 29 are disposed below the rollers 24, and 26.

Moreover, a recording head array 30 is arranged above the conveying belt 28, opposing to a flat portion 28F of the conveying belt 28 between the driving roller 24 and the driven roller 26. This opposed region is a discharged region SE to which ink droplets are discharged from the recording head array 30. The paper P which has been conveyed on the conveyance path 22 reaches the discharged region SE, held by the conveying belt 28, and ink droplets corresponding to image information adheres to the paper P from the recording head array 30 under a state the paper P is opposing to the recording head array 30.

In the embodiment, the recording head array 30 is configured to have a long-length shape in such a way that the length of an effective recording region is longer than the width (the length in the direction perpendicular to the conveying direction) of the paper P, and four ink jet recording heads (hereinafter, referred to as recording heads), which are corresponding to each of four colors of yellow (Y), magenta (M), cyan (C), and black (K), and function as the liquid droplet discharging head, are arranged along the conveying direction to record a full color image.

Each of the recording heads 32 is driven by a head driving circuit (not shown).

The head driving circuit has a configuration in which, the discharging timing of ink droplets and an ink discharging opening (nozzle) to be used are decided, for example, according to image information to send a driving signal to the recording head 32.

Moreover, the recording head array 30 may be configured not to move in a direction perpendicular to the conveying direction, but, when configured to move as required, an image with a higher resolution may be recorded by multipath image recording, and a malfunction of the recording head 32 may be prevented from being reflected on recorded results.

Figure 2:
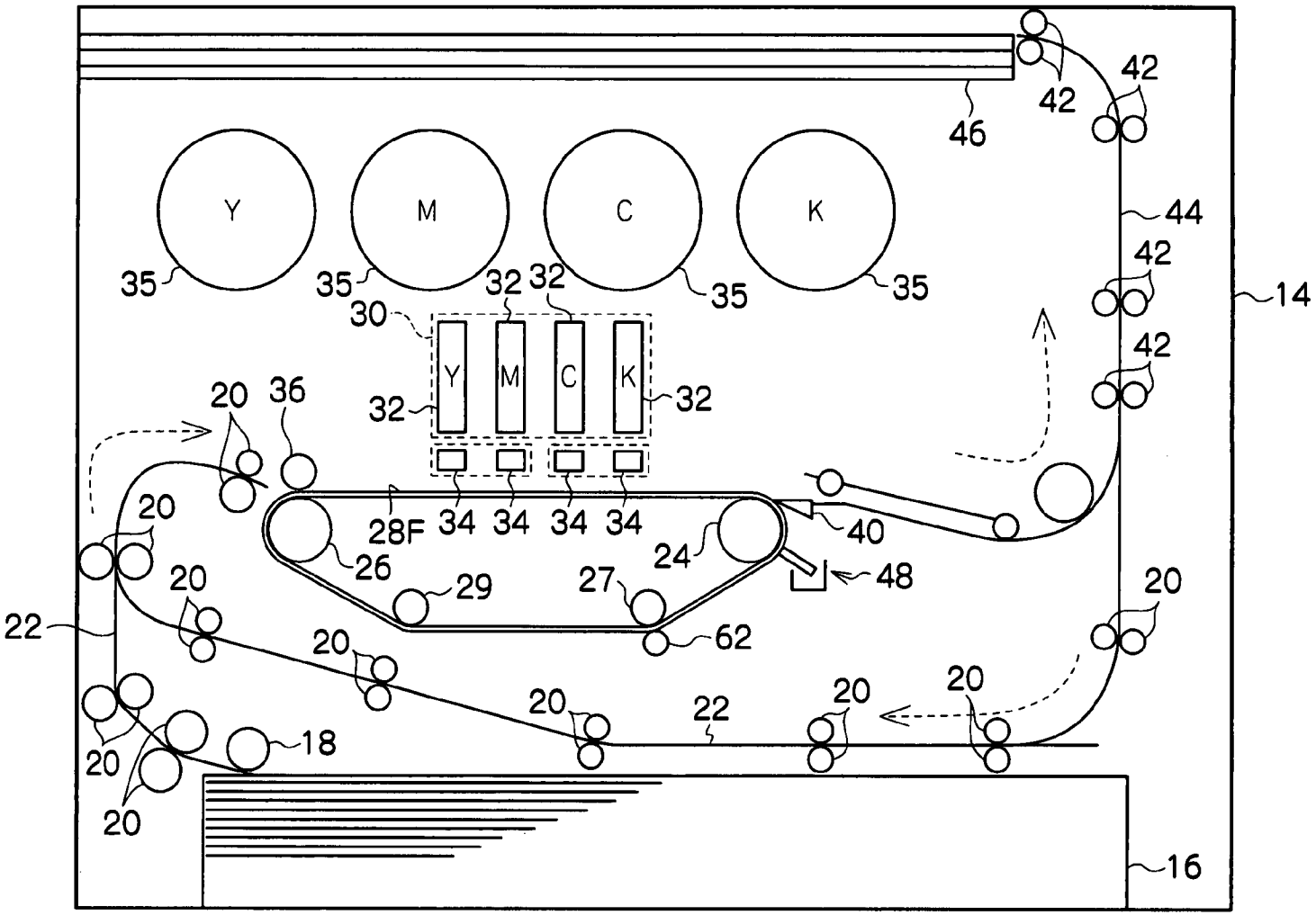
FIG. 2 is a schematic side view showing the ink jet recording device according to the first embodiment of the invention.

Four maintenance units 34 corresponding to each of the recording heads 32 are arranged on either side of the recording head array 30. During a maintenance operation of the recording head 32, the recording head array 30 is moved upward, and the maintenance units 34 move and enter into a space formed between each of the heads 32 and the conveying belt 28 as shown in FIG. 2. Then, each of the maintenance units 34 perform a predetermined maintenance operation (sucking, wiping, capping and the like), opposing to a corresponding nozzle surface.

Moreover, ink tanks 35 storing each color ink are arranged in the upper portion of the recording head array 30. Each of the recording heads 32 is connected to the ink tanks 35.

Figure 3:
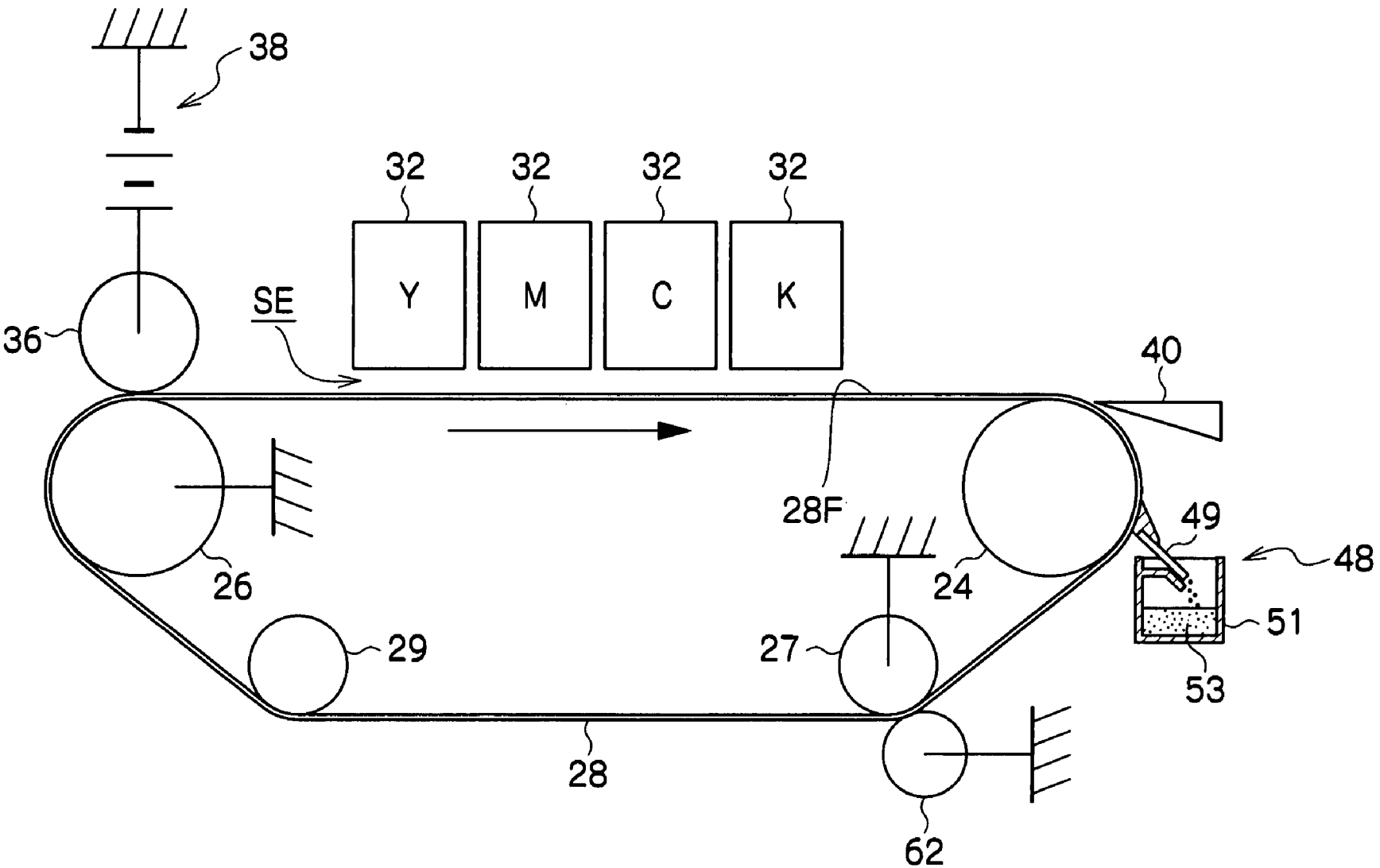
FIG. 3 is a schematic side view showing a printing section in the ink jet recording device according to the first embodiment of the invention.

As shown in FIG. 3, a charging roller 36 to which a power supply 38 is connected is arranged on the upstream side of the recording head array 30. The charging roller 36 presses the paper P to the conveying belt 28 while the roller 36 is driven under a state in which the conveying belt 28 and the paper P are inserted between the driven roller 26 and the roller 36. As a predetermined potential difference is generated between the grounded driven roller 26 and the roller 36 at this time, electric charges are given to the paper P which is electrostatically attracted to the conveying belt 28.

A separating pawl 40 is arranged on the downstream side of the recording head array 30, and separates a paper P from the conveying belt 28. The separated paper P is conveyed through a plurality of delivery roller pairs 42 forming a delivery path 44 on the downstream side of the separating pawl 40, and is delivered to a paper delivery tray 46 provided in the upper portion of the casing 14.

Moreover, a belt cleaning unit 48 is arranged below the separating pawl 40. The belt cleaning unit 48 abuts against a portion at which the conveying belt 28 is wound around the driving roller 24, and is provided with a blade 49, which scrapes off ink and the like, which have adhered to the conveying belt 28, as a first blade, and a collecting box 51 collecting ink and the like, which have been scraped off from the conveying belt 28, using the blade 49. Moreover, an absorbing body 53 is spread over the bottom of the collecting box 51, and absorbs liquid dropped from the blade 49.

Moreover, a grounded static eliminating roller 62 is arranged on the downstream side of the belt cleaning unit 48. The static eliminating roller 62 eliminates electric charges on the conveying belt 28 while the roller 62 is driven under a state in which the conveying belt 28 is inserted between the driven roller 27 and the roller 62.

Figure 4:
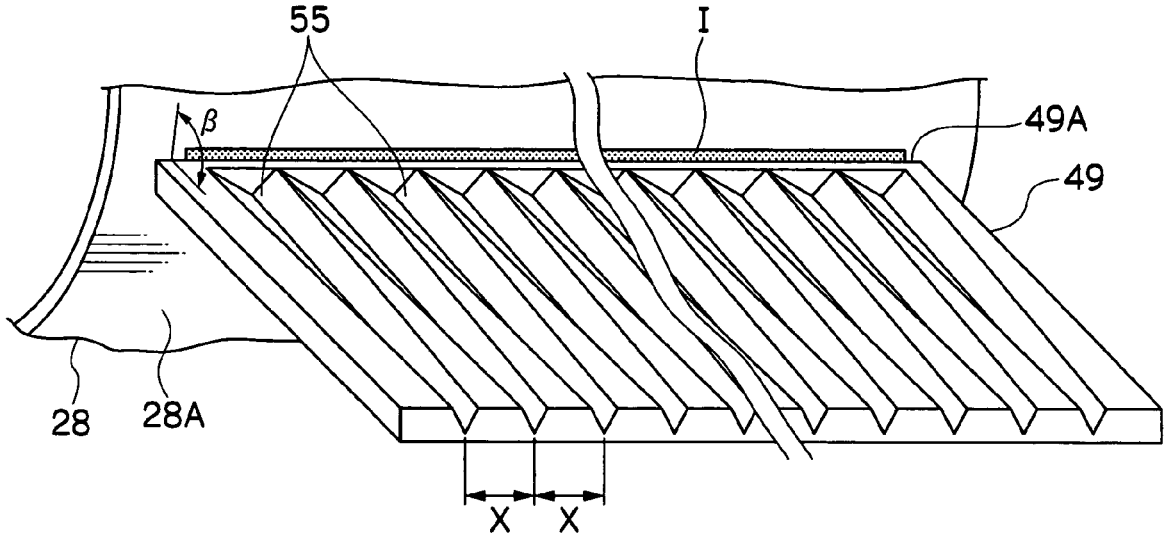
FIG. 4 is a perspective view showing a blade and a conveying belt provided in the ink jet recording device according to the first embodiment of the invention.

Incidentally, the blade 49 is of a rectangular plate material, and scrapes off ink I adhered to the conveying belt 28, while the whole surface of the corner portion (edge) 49A at the side of the one end in the width direction (the side of the conveying belt 28) is kept in contact with the outer peripheral surface 28A of the conveying belt 28, as shown in FIG. 4. Moreover, the blade 49 is configured to apply against the conveying belt 28 at an angle of β, and to be inclined downward at the side of the other end in the width direction (the feed-back side of the conveying belt 28). Moreover, a plurality of V-groove 55, which have a groove width gradually increasing from a bottom portion 55A to an opening portion 55B (see FIGS. 7A and 7B) and extend from the side of the conveying belt 28 to the feed-back side of the belt 28, are continuously formed on the surface of the blade 49 at the upstream side (the upper side in the drawing) of the rotation direction of the conveying belt 28 along the longitudinal direction with a predetermined pitch X. Each of the V-grooves 55 is formed from the opposite side of the conveying belt 28 to the vicinity of the edge 49A of the belt 28 in such a way that the edge 49A has a straight-line structure.

Figure 5:
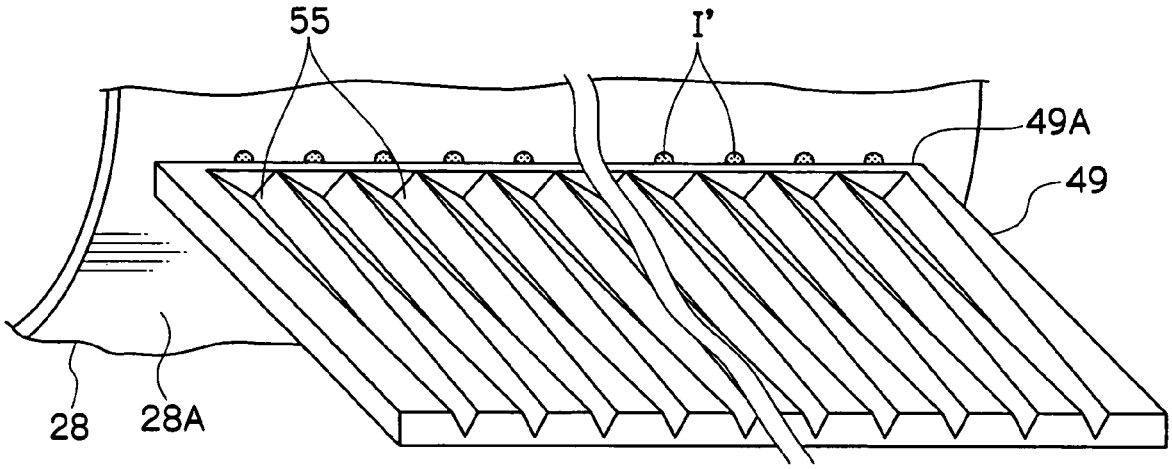
FIG. 5 is a perspective view showing the blade and the conveying belt provided in the ink jet recording device according to the first embodiment of the invention.
Figure 6:
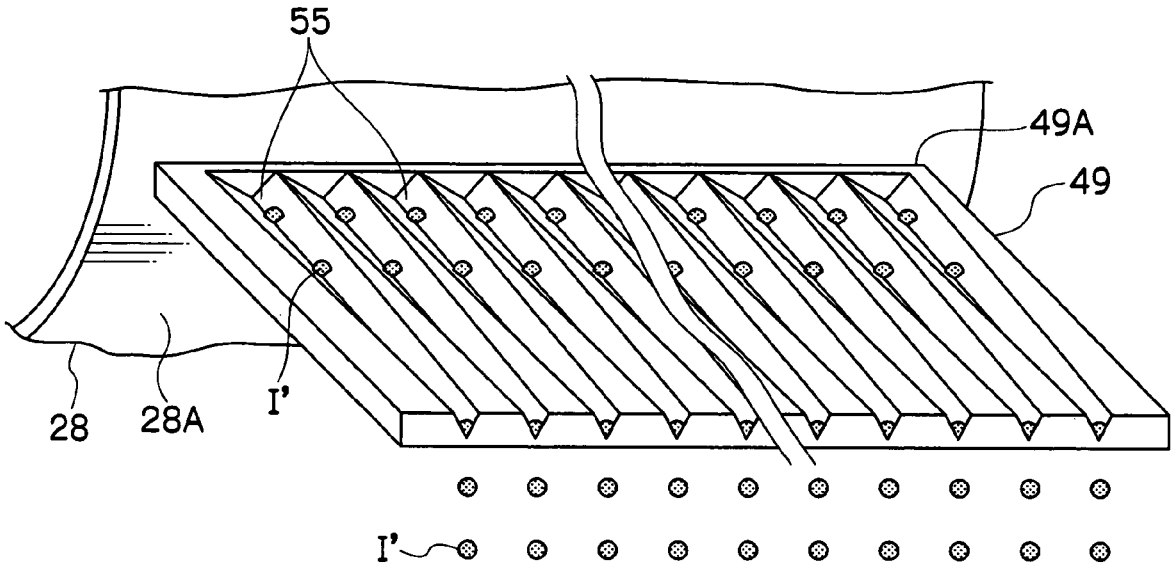
FIG. 6 is a perspective view showing the blade and the conveying belt provided in the ink jet recording device according to the first embodiment of the invention.

Accordingly, the ink I which has been scraped off from the conveying belt 28 by the edge 49A of the blade 49 becomes pillar-shaped at the corner portion, which is formed with the edge 49A and the conveying belt 28, in the first place, and, secondly, is split by the surface tension into ink droplets I' as shown in FIG. 5. And, the ink droplet I' drops onto the V-groove 55, flows down along the groove 55 to the side of the opposite end of the blade 49 in the width direction, and drops from the opposite end portion of the blade 49 in the width direction to the collecting box 51 as shown in FIG. 6.

Figure 7A:
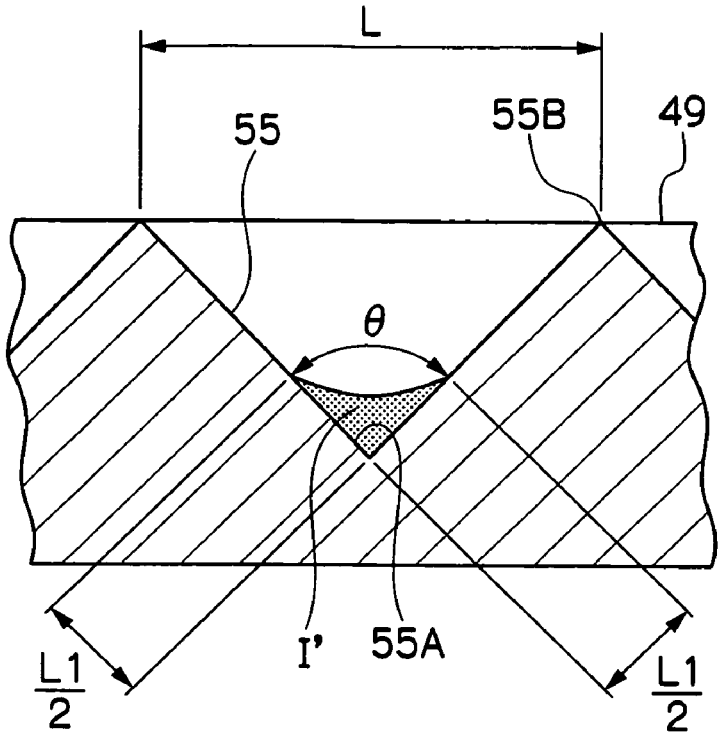
FIG. 7A is a cross sectional view showing an end portion of the blade, which is provided in the ink jet recording device according to the first embodiment of the invention, on the upstream side in the flowing direction.
Figure 7B:
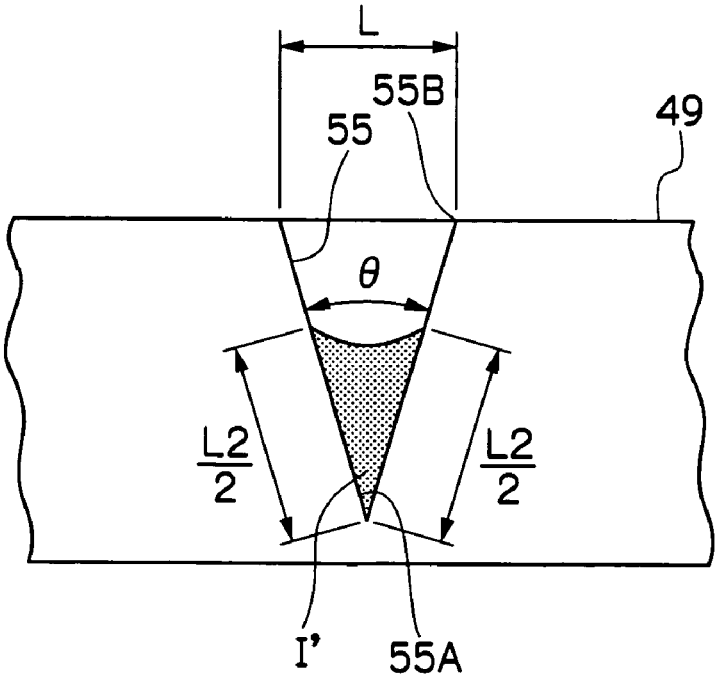
FIG. 7B is a side view showing an end portion of the blade, which is provided in the ink jet recording device according to the first embodiment of the invention, on the downstream side in the flowing direction.

Moreover, FIG. 7A shows the cross section of an end portion of the blade 49 on the upstream side in the flowing direction of the ink droplet I' (hereinafter, referred to as the flowing direction), and FIG. 7B shows the cross section of an end portion of the blade 49 on the downstream side in the flowing direction.

Figure 8:
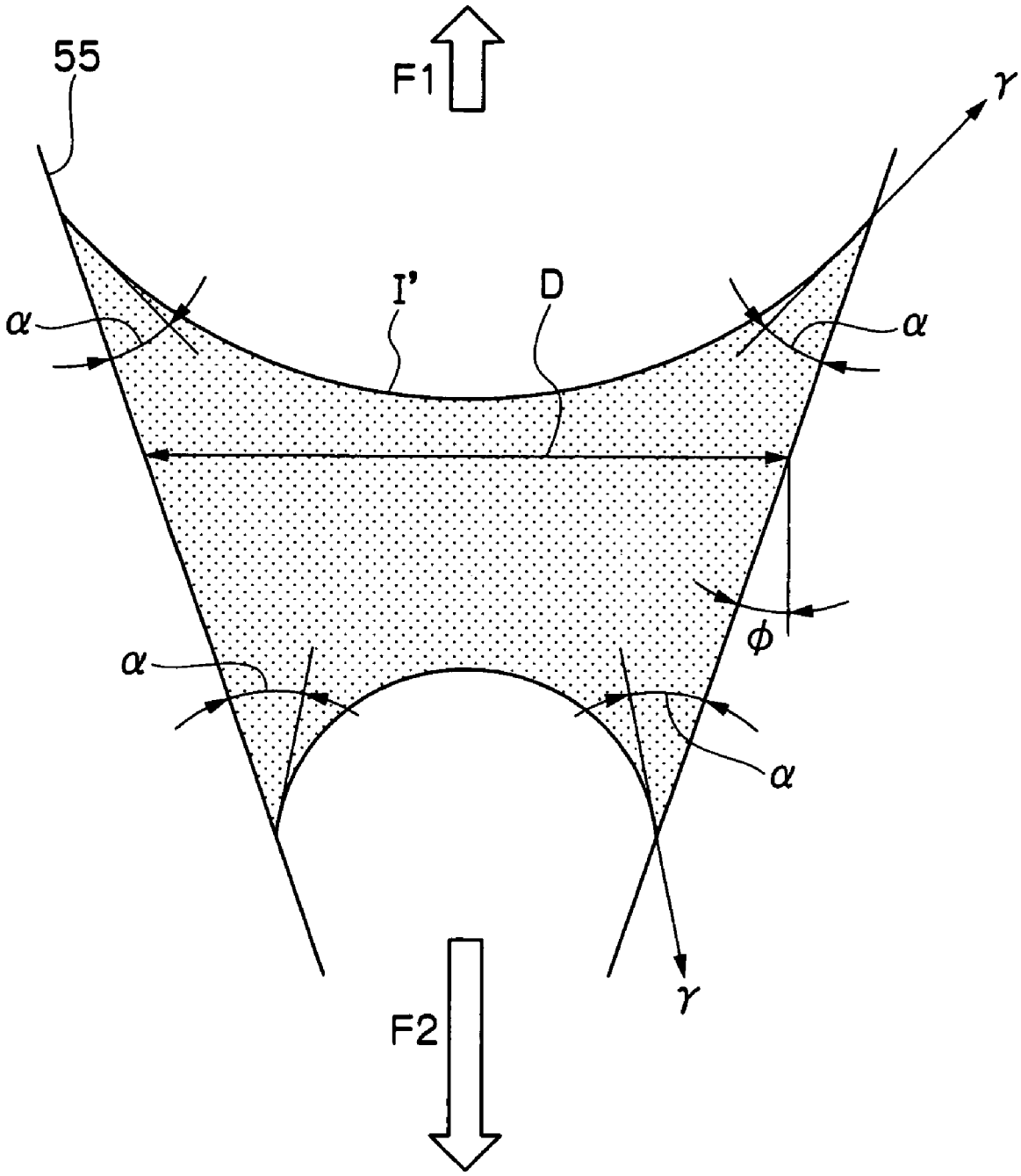
FIG. 8 is a schematic plan view showing an ink droplet flowing in a V-groove formed on the blade provided in the ink jet recording device according to the first embodiment of the invention.

As shown in FIGS. 7A and 7B, an angle (groove angle) θ between one wall surface and the other one of the V-groove 55 gradually decreases from the upstream side to the downstream side of the flowing direction. Accordingly, the width D in a direction perpendicular to the flowing direction of the ink droplet I' flowing in the V-groove 55 gradually decreases from the upstream side to the downstream side of the flowing direction as shown in FIG. 8.

Moreover, a film with an affinity for aqueous ink, that is, with a hydrophilic property is formed on the wall surface of the V-groove 55. Accordingly, an contact angle α between the ink droplet I' and the wall surface of the V-groove 55 becomes less than 90 degrees. And the surface shape of the ink droplet I' on the upstream side in the flowing direction becomes concave in an arc shape on the downstream side, and the surface shape of the ink droplet I' on the downstream side in the flowing direction becomes concave in an arc shape on the upstream side.

Incidentally, surface tension F1 of the ink droplet I' on the upstream side in the flowing direction and surface tension F2 of the ink droplet I' on the downstream side in the flowing direction satisfy the following formulae (A) and (B), assuming that surface tension at one point on the surface of the ink droplet I' in contact with the wall surface of the V-groove 55 is γ, a contact distance of the ink droplet I' with the wall surface of the V-groove 55 on the upstream side in the flow direction is L1, a contact distance of the ink droplet I' with the wall surface of the V-groove 55 on the downstream side in the flow direction is L2, and the downstream side of the blade 49 in the flowing direction is located downward from the upstream side. Moreover, ϕ is an angle of gradient of the wall surface of the V-groove 55 relative to the flowing direction.

$$F1=\gamma L1\cos(\alpha+\phi) \quad (A)$$

$$F2=\gamma L2\cos(\alpha-\phi) \quad (B)$$

Where α, ϕ, L1, and L2 satisfy the following formulae (C) and (D):

$$0<\alpha<\pi/2,\ 0<\phi<\pi/2 \quad (C)$$

$$L1<L2,\ L1>0,\ L2>0 \quad (D)$$

Accordingly, the fluidity of the ink droplet I' to the downstream side is improved as compared with a conventional configuration because F2 is smaller than F1, and force (F2−F1) from the upstream side to the downstream side in the flowing direction, in addition to the gravity, is applied to the ink droplet I', as shown in FIG. 8. Accordingly, ink may be further prevented from remaining on the blade 49, and defective cleaning of the conveying belt 28 by the blade 49 may be more controllable as compared with a conventional configuration.

Here, the pitch X of the V-groove 55 formed on the blade 49 will be explained.

Figure 9A:
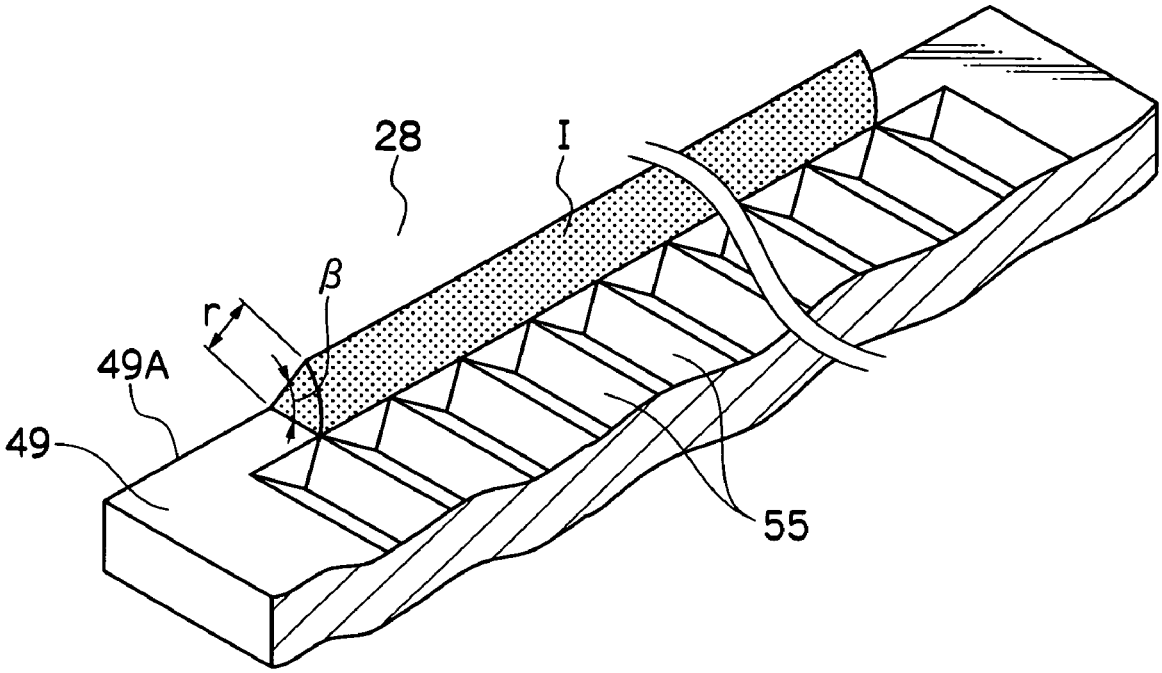
FIG. 9A is a perspective view showing the blade provided in the ink jet recording device according to the first embodiment of the invention.

The volume V of the ink I remained at the edge 49A of the blade 49 in a pillar shape as shown in FIG. 9A is represented by the following formula (1). Here, r is the radius of the ink I in a pillar shape, and β is an abutting angle between the above-described blade 49 and the conveying belt 28.

$$V=\pi r2\beta/2\pi \quad (1)$$

In the embodiment, β is equal to 64 degrees. Moreover, the embodiment has a configuration in which 200 pieces of ink droplets are discharged at one time at dummy jetting, and the volume [$m^3$/m] of the ink I which remains on the edge 49A at the discharging is represented by the following formula (2).

$$V[m^3/m]=a[pl]\times b\times c\times d[dpi] \quad (2)$$

Where a is the volume of one dot, b is the number of discharged dots, c is the number of the recording heads 32, and d is a resolution. In the embodiment, assuming that a=10, b=200, c=4, and d=600, V becomes 1.89.

Thereby, the radius r of the ink I with a pillar shape is represented by the following formula (3).

$$r=\sqrt{(2V/\beta)}=0.6\ [mm] \quad (3)$$

Figure 9B:
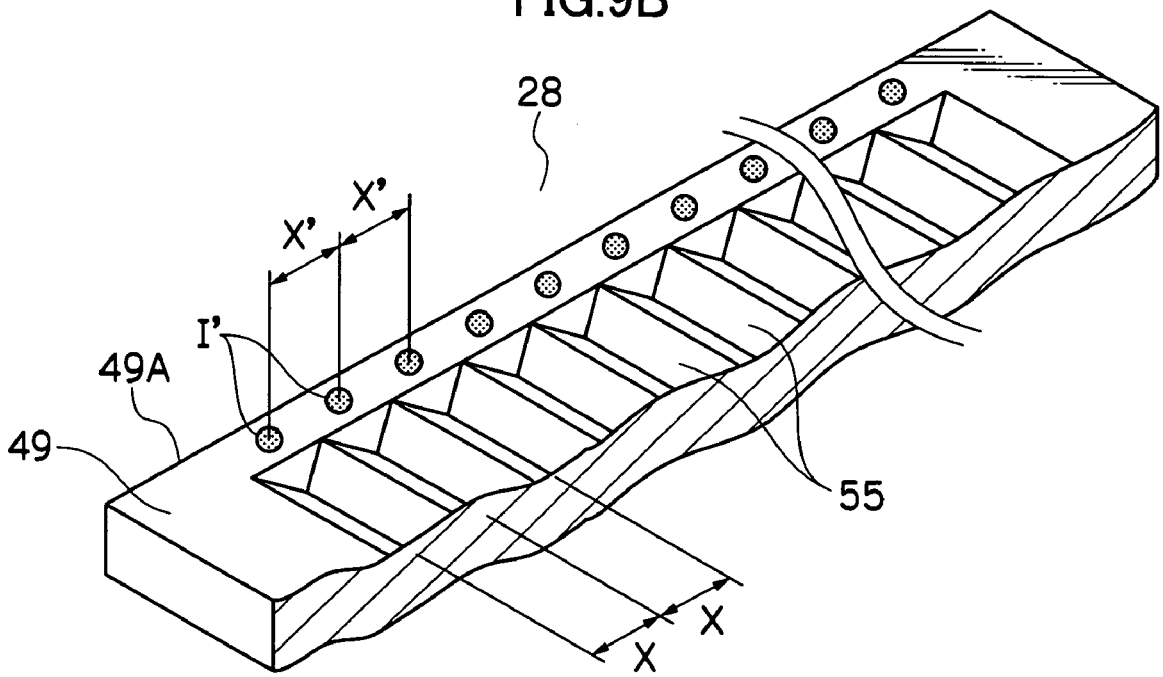
FIG. 9B is a perspective view showing the blade provided in the ink jet recording device according to the first embodiment of the invention.

Moreover, when the ink I which has been remained pillar-shaped at the edge 49A is split to a plurality of ink droplets I' as shown in FIG. 9 B, the pitch X' of a plurality of the ink droplets I' is represented by the following formula (4), based on a Rayleighy theory on linear stability.

$$X'=9n\ r=5.4n[mm](n=1, 2, \ldots) \quad (4)$$

On the other hand, the pitch X of a plurality of the V-grooves 55 is configured to be decided in such a way that the following formula (5) is satisfied.

$$X=9n\ r=5.4n[mm]\ (n=1, 2, \ldots) \quad (5)$$

That is, the pitch X' a plurality of the ink droplets I' into which the ink I in a pillar shape is split on the edge 49A is equal to the pitch X of a plurality of the V-grooves 55.

Accordingly, the split ink droplets I' drop onto each of the V-groove 55 one by one, and a large volume of ink never flows into one V-groove 55 all together.

Here, as there is a phase difference between the ink droplet I' and the V-groove 55, the width L of the V-groove 55 on the side of the edge 49 is desired to be wider. Accordingly, the width L is made equal to the pitch X in the embodiment.

Here, when many of solvents of the ink are water as described in the embodiment, a material with a hydrophilic property may be used for the material of the film formed on the wall surface of the V-groove 55. Materials satisfying the above requirement may be listed as follows: for example, hydrophilic polymer such as carboxymethyl-cellulose; water-soluble polymer such as polyvinyl alcohol, chitosan, various kinds of polyelectrolyte, polyethylene oxide, water-soluble cellulose acetate, and carboxymethylcellulose; and an adsorbent such as zeolite.

Moreover, for example, when many of solvents of ink are alcohol, a material with an affinity for alcohol may be used as the member of the film formed on the wall surface of the V-groove 55. For example, a material obtained by melting polyvinyl butyral into isopropyl, cellulose acetate, and high silica zeolite may be used.

Then, a second embodiment according to the invention will be explained. Here, components similar to those in the first embodiment are denoted in the embodiment by the same reference numerals as those in the previous embodiment, and detailed description will be eliminated.

Figure 10:
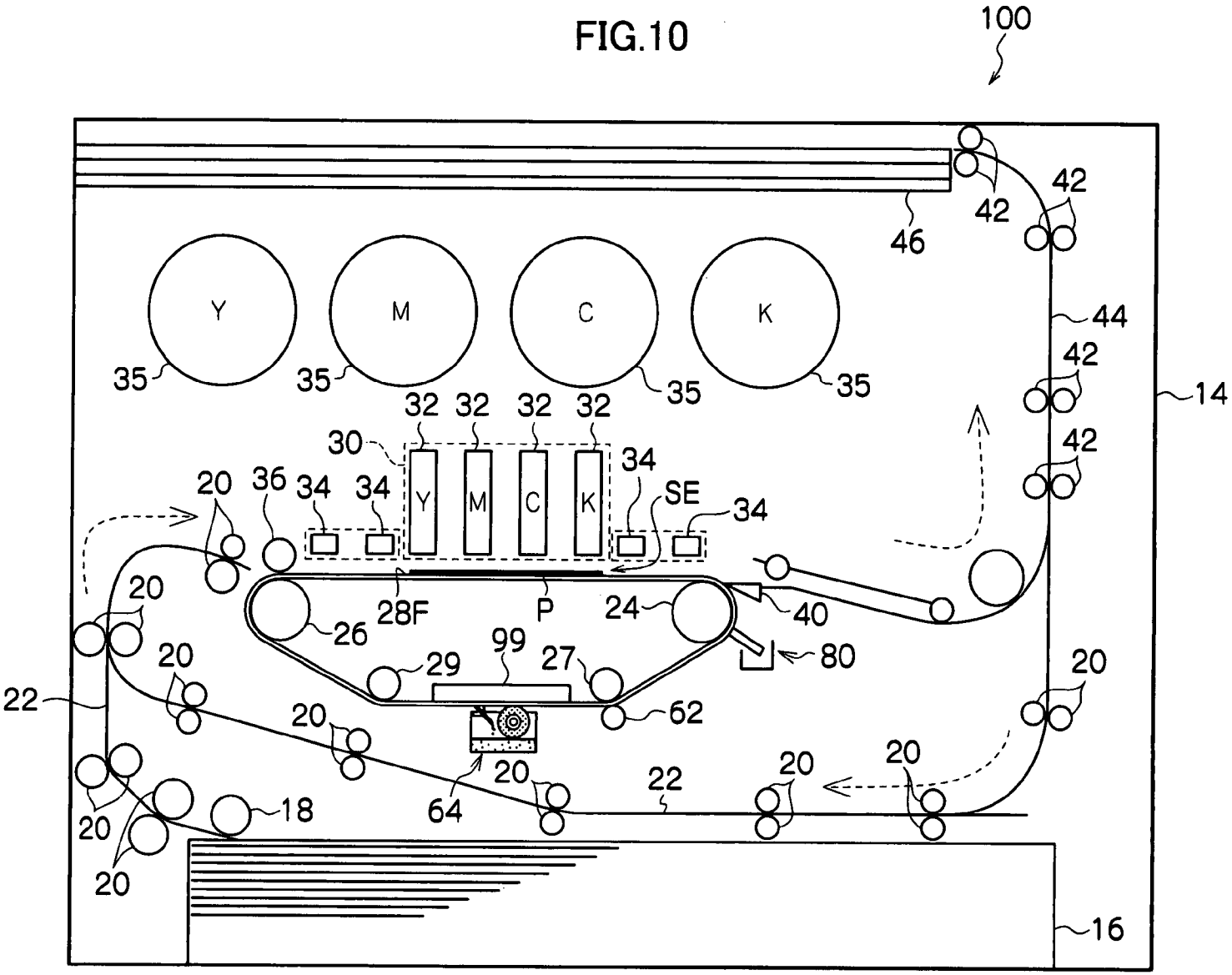
FIG. 10 is a schematic side view showing an ink jet recording device according to a second embodiment of the invention.
Figure 11:
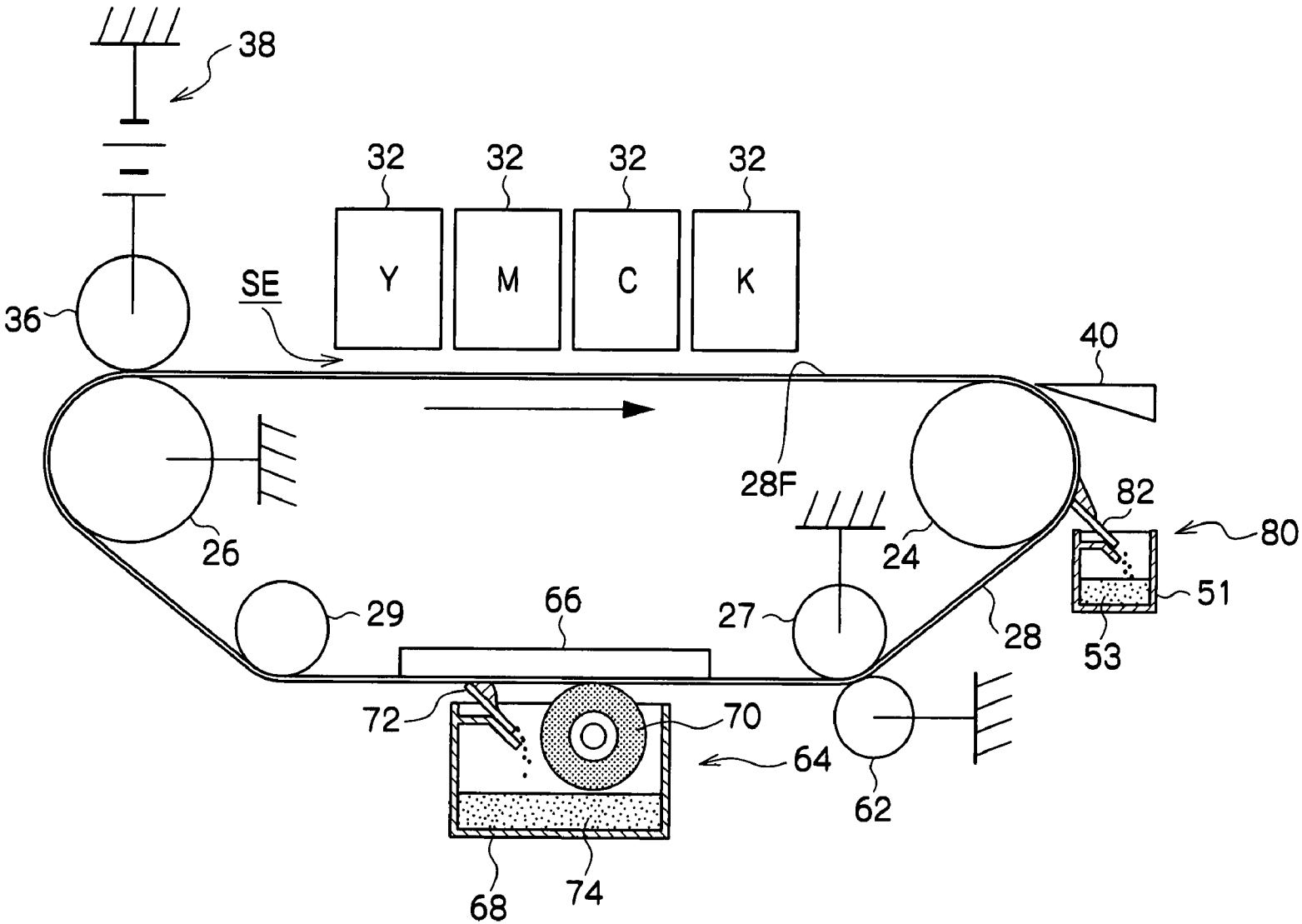
FIG. 11 is a schematic side view showing a printing section in the ink jet recording device according to the second embodiment of the invention.

FIG. 10 shows an ink jet recording device 100 as a liquid droplet discharging device according to the embodiment, and FIG. 11 shows an enlarged view of the principal portion of the ink jet recording device 100.

A belt cleaning unit 80 is arranged below a separating pawl 40. As shown in FIG. 11. The belt cleaning unit 80 abuts against a portion at which a conveying belt 28 is wound around a driving roller 24, and is provided with a blade 82, which scrapes off ink and the like, which have adhered to the conveying belt 28, and a collecting box 51 for collecting ink and the like, which have been scraped off from the conveying belt 28, using the blade 82. Moreover, an absorbing body 53 is spread over the bottom of the collecting box 51, and absorbs liquid dropped from the blade 82.

Moreover, an oil coating unit 64 and a backup plate 66 are opposing to each other through the conveying belts 28 between driven rollers 26 and 27. The oil coating unit 64 is opposing to the outer peripheral surface of the conveying belt 28, and the backup plate 66 abuts against inner peripheral surface of the conveying belt 28.

The oil coating unit 64 is provided with a case 68, an oil coating roller 70, which is rotatably supported by a case 68, as a coating member, and a blade 72, which is supported by the case 68, for oil. The oil coating roller 70 is pressed against the backup blade 66 through the conveying belts 28, and is driven by the conveying belt 28 for rotation. Moreover, the oil coating roller 70 is formed of a porous body such as polyethylene and urethane, is impregnated with silicone oil, and paints the silicone oil on the conveying belt 28. On the other hand, the ink discharged from a recording head 32 is water ink. Accordingly, when ink adheres to the conveying belt 28 by unnecessary ink discharging at paper jam, or by dummy jetting at which ink is discharged on the conveying belt 28, ink particles cling together by a water-repelling effect of a silicone film on the conveying belt 28. Accordingly, increase in force by which ink adheres to the conveying belt 28 may be controlled, and, when the conveying belt 28 is cleaned, using the blade 82, the ink is easily separated from the conveying belt 28.

Here, as the dummy jetting is performed with a short period such as once every tens of seconds in order to prevent ink in the recording head 32 from thickening, it is effective to form the film of the silicone oil on the conveying belt 28 at any time as described in the embodiment.

Moreover, the oil coating roller 70 may be configured to be a driving roller. In this case, the oil coating roller 70 may be prevented from sliding over the conveying belt 28.

Moreover, the blade 72 for oil abuts against the conveying belt 28 on the downstream side of the conveying belt 28 from the oil coating roller 70 in the rotation direction, and scrapes off the surplus of silicone oil applied on the conveying belt 28 to obtain a predetermined film thickness of the silicone oil. Here, the blade 72 for oil uses rubber such as fluoro rubber and nitrile-butadiene rubber (NBR), a metal thin plate of SUS and the like, a resin film of polyurethane, poly-ethylene terephthalate (PET) and the like, and the like.

Moreover, an absorbing member 74 such as a sponge is spread over the bottom of the case 68, and absorbs silicone oil scraped off from the conveying belt 28 by the blade 82 for oil.

Moreover, the conveying belt 28 uses stuff which is formed of resin such as PET, polyimide (PI), polyamide (PA), polycarbonate (PC), or a rubber material such as chromium (CR), nitrile-butadiene rubber (NBR), hydrogenated nitride butadiene rubber (HNBR), and urethane rubber, and the surface of which is coated; and the like. Moreover, the blade 49 uses stuff formed of a rubber material such as fluoro rubber, NBR, and HNBR a thin metal plate of SUS and the like, a film formed of resin such as polyurethane and PET, and the like. Moreover, nonwoven fabric formed of polyester and the like is preferably used for the roll portion of the oil coating roller 70, but other stuff which may be impregnated with a predetermined amount of ink and may be taken up may be used for the above portion.

Moreover, silicone oil is used as a liquid (hereinafter, referred to as coating liquid) applied on the conveying belt 28 by the oil coating roller 70 as described above, and water ink is used for the ink. Here, liquid which repels ink is suitable for the coating liquid, and, other than silicone oil, higher fatty acid such as oleic acid, and linolic acid, a plasticizer such as dibutyl phthalate, diisodecyl phthalate, and dibutyl maleate, non-aqueous alcohols such as n-decanol and dimetylbutanol, and water repellent liquid such as fluorine oil, mineral oil, and vegetable oil may be used for the water ink. Moreover, liquid, such as water, with a better oil repellent property may be used for oil ink.

Moreover, in order to stabilize coating of the coating liquid on the conveying belt 28, the kinematic viscosity of the coating liquid is, preferably, within a range of 10 $mm^2/s$-104 $mm^2/s$, and, more preferably, within 50 $mm^2/s$-102 $mm^2/s$.

Moreover, the applied thickness of the coating liquid is required to be set within a suitable range because, when the applied thickness of the coating liquid is too large, there is a possibility to cause an adverse effect on the picture quality, for example, oil is permeated into paper P, and the paper P repels ink, and, conversely, when the applied thickness of the coating liquid is too small, ink is not preferably cleaned by the blade 49. A suitable range of the applied thickness of the coating liquid is within a range of 1 nanometers-20 micrometers.

Moreover, the coating liquid is required to be non-volatile at ordinary temperatures. Specifically, the vapor pressure is 13.33 Pa or less at 25 degrees centigrade. Moreover, the coating liquid is required to have incompatibility with ink. Specifically, the solubility is 0.1 weight percents or less at ordinary temperatures (25 degrees centigrade)

Figure 12:
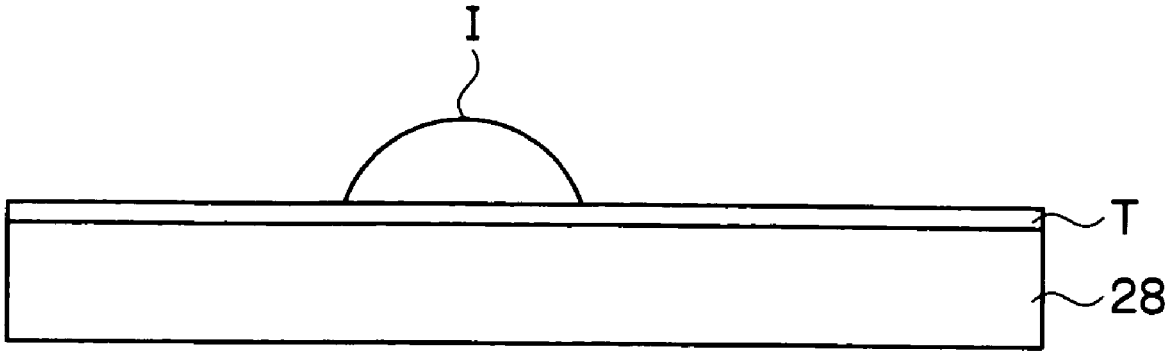
FIG. 12 is an enlarged cross sectional view showing a conveying belt in the ink jet recording device according to the second embodiment of the invention.

Moreover, the following formula (E) is required to be satisfied because the coating liquid is required to wet-spread over the conveying belt 28: Here, it is assumed, as shown in FIG. 12, that the surface tension of coating liquid T is $\gamma 0$, and a critical surface tension of the conveying belt 28 is $\gamma$ b. Moreover, the critical surface tension means surface tension which is obtained when cos $\theta$ is corrected to one in various kinds of relations between the surface tensions of liquid and contact angles $\theta$s thereof to the surface of a solid body (that is, when the contact angle of liquid to the surface of a solid body becomes zero degree). Generally, the surface of a solid body has good wettability to liquid having a surface tension which is smaller than a critical surface tension for the surface of the solid body.

$$\gamma 0<\gamma b \quad (E)$$

Moreover, the following formula (F) is required to be satisfied in order to obtain water-repellant coating liquid T. Where the surface tension of ink I is assumed to be $\gamma$ i.

$$\gamma 0<\gamma i \quad (F)$$

Thereby, ink I does not wet-spread over the film of the coating liquid T for aggregation. Moreover, experiments for evaluation of the cleaning performance were conducted under conditions in which the conveying belt 28 was a PET belt with a critical surface tension $\gamma$ b of about 43 [mN/m], the coating liquid is silicone oil with a surface tension $\gamma$ 0 of about 20 [mN/m], and the ink is water ink with a surface tension of $\gamma$ i of about 30 [mN/m] Result of doing experiment by which cleaning performance is evaluated as water ink. In the above experiments, there did not exist ink fouling on the conveying belt 28, and the excellent cleaning performance was obtained.

Figure 13:
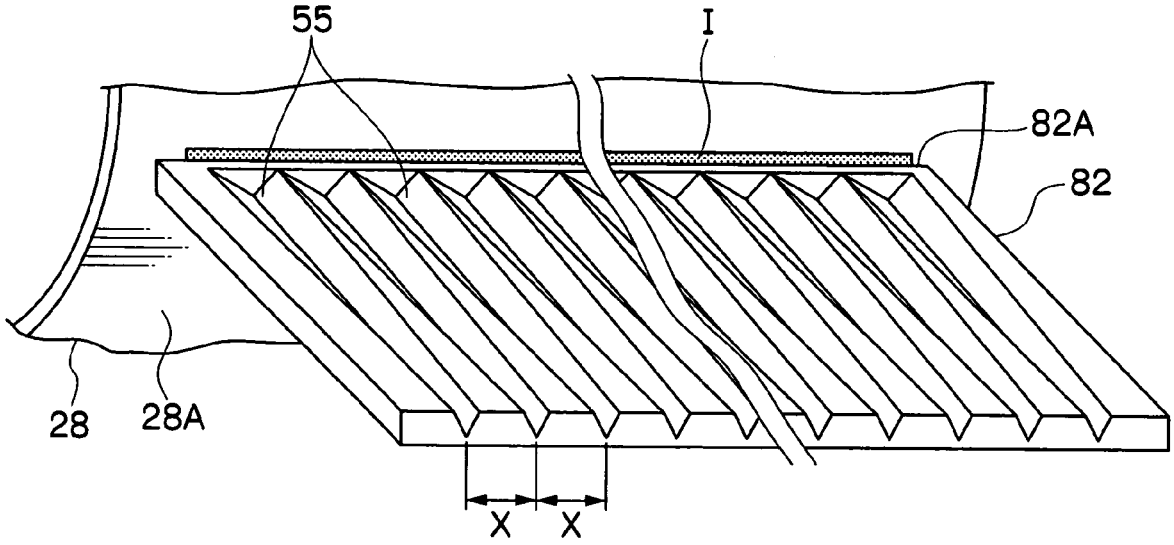
FIG. 13 is a perspective view showing a blade and the conveying belt provided in the ink jet recording device according to the second embodiment of the invention.
Figure 14A:
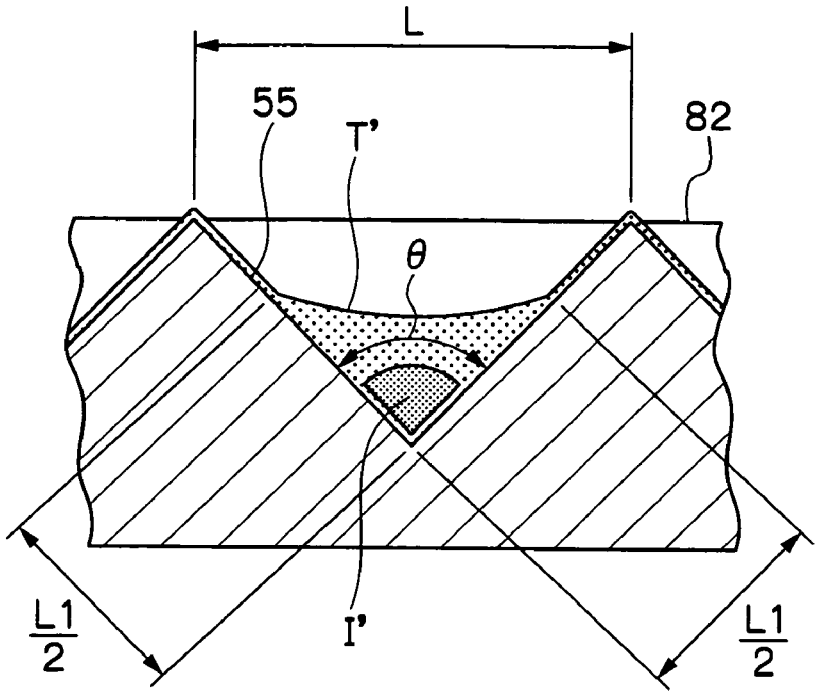
FIG. 14A is a cross sectional view showing an end portion of the blade, which is provided in the ink jet recording device according to the second embodiment of the invention, on the upstream side in the flowing direction.
Figure 14B:
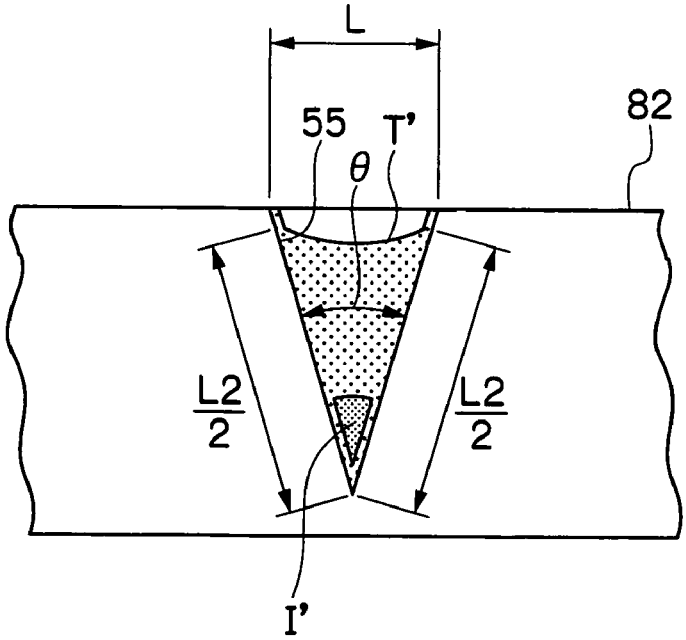
FIG. 14B is a side view showing an end portion of the blade, which is provided in the ink jet recording device according to the second embodiment of the invention, on the downstream side in the flowing direction.

Incidentally, the blade 82 has the same shape as that of the blade 49 in the first embodiment, and the coating liquid T is scraped off from the conveying belt 28 by an edge 82A, as shown in FIGS. 13, 14A and 14B.

Here, a film with an affinity for the coating liquid T, that is, a lipophilic property is formed on the wall surface of the V-groove 55.

Figure 15:
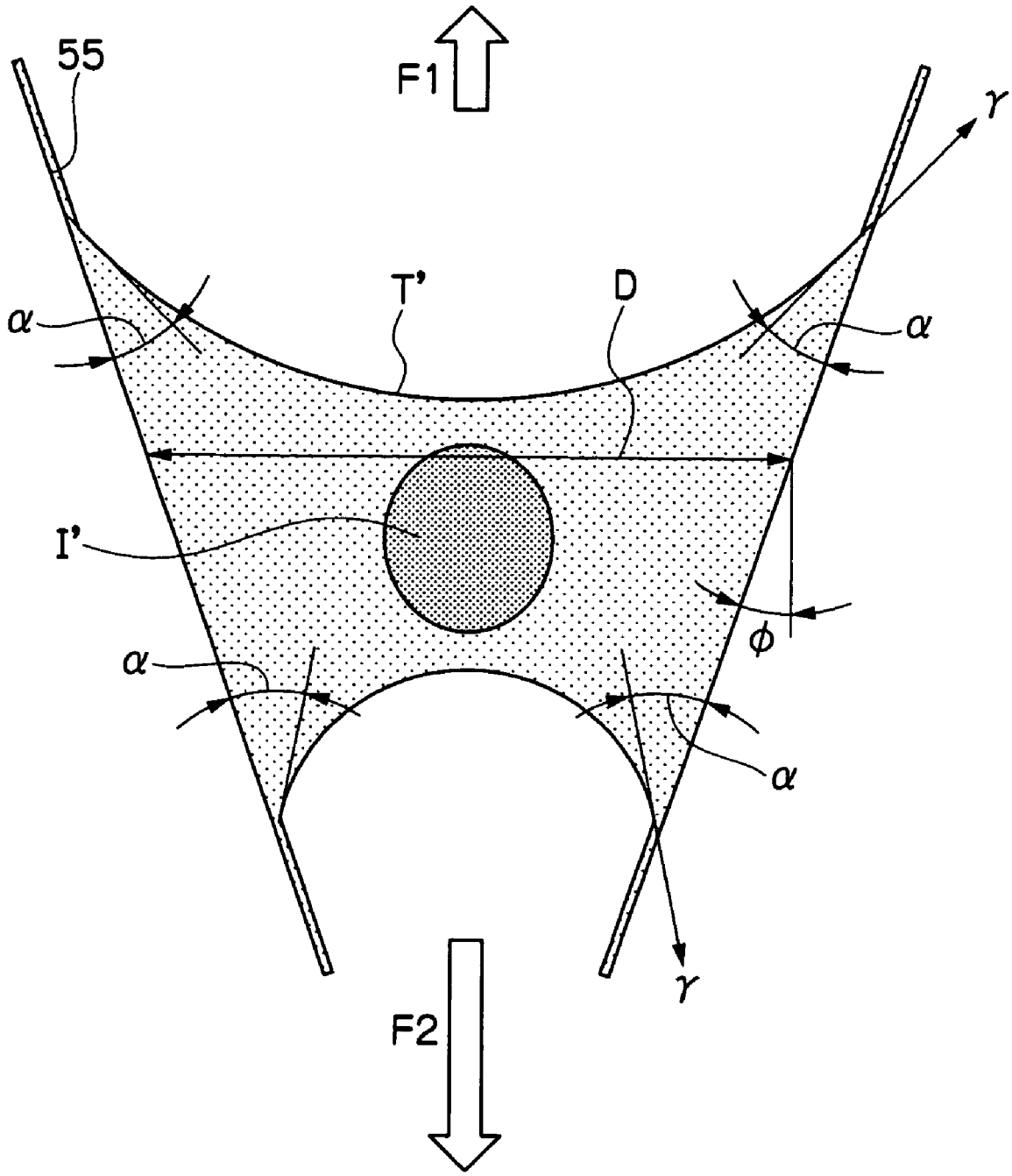
FIG. 15 is a schematic plan view showing an ink droplet flowing in a V-groove formed on the blade provided in the ink jet recording device according to the second embodiment of the invention.

Thereby, the film of the coating liquid T is formed on the wall surface of the V-groove 55, and an ink droplet I' is wrapped in a liquid droplet T' into which the coating liquid T is split. Moreover, as shown in FIG. 15, a contact angle $\alpha$ between the liquid droplet T' and the wall surface of a groove 84 is less than 90 degrees, and a surface shape on the upstream side in a flowing direction of the liquid droplet T' (hereinafter, referred to as flowing direction) becomes concave in an arc shape on the downstream side, and the surface shape of the ink droplet I' on the downstream side in the flowing direction becomes concave in an arc shape on the upstream side.

Here, when the surface tension of the whole liquid droplet T' is assumed to be γ, surface tension F1 of the liquid droplet T' on the upstream side in the flowing direction, surface tension F2 of the liquid droplet T' on the downstream side in the flowing direction, angles α and ϕ satisfy the above-described formulas (A), (B), (C), and (D). Accordingly, the following formula is obtained: F2>F1. Thereby, the fluidity of the ink droplet I' to the downstream side is promoted because force (F2−F1) from the upstream side to the downstream side in the flowing direction, in addition to the gravity, is applied to the liquid droplet T'. Therefore, ink may be further prevented from remaining on the blade 82, and defective cleaning of the conveying belt 28 by the blade 82 may be more controllable as compared with a conventional configuration.

Moreover, when coating liquid T is oil liquid as described in the embodiment, a material with a lipophilic property, for example, silicon resin and the like may be used for the film material formed on the wall surface of the groove 84.

Subsequently, a third embodiment according to the invention will be explained. Here, components similar to those in the first and second embodiments are denoted in the embodiment by the same reference numerals as those in the previous embodiments, and detailed description will be eliminated.

Figure 16:
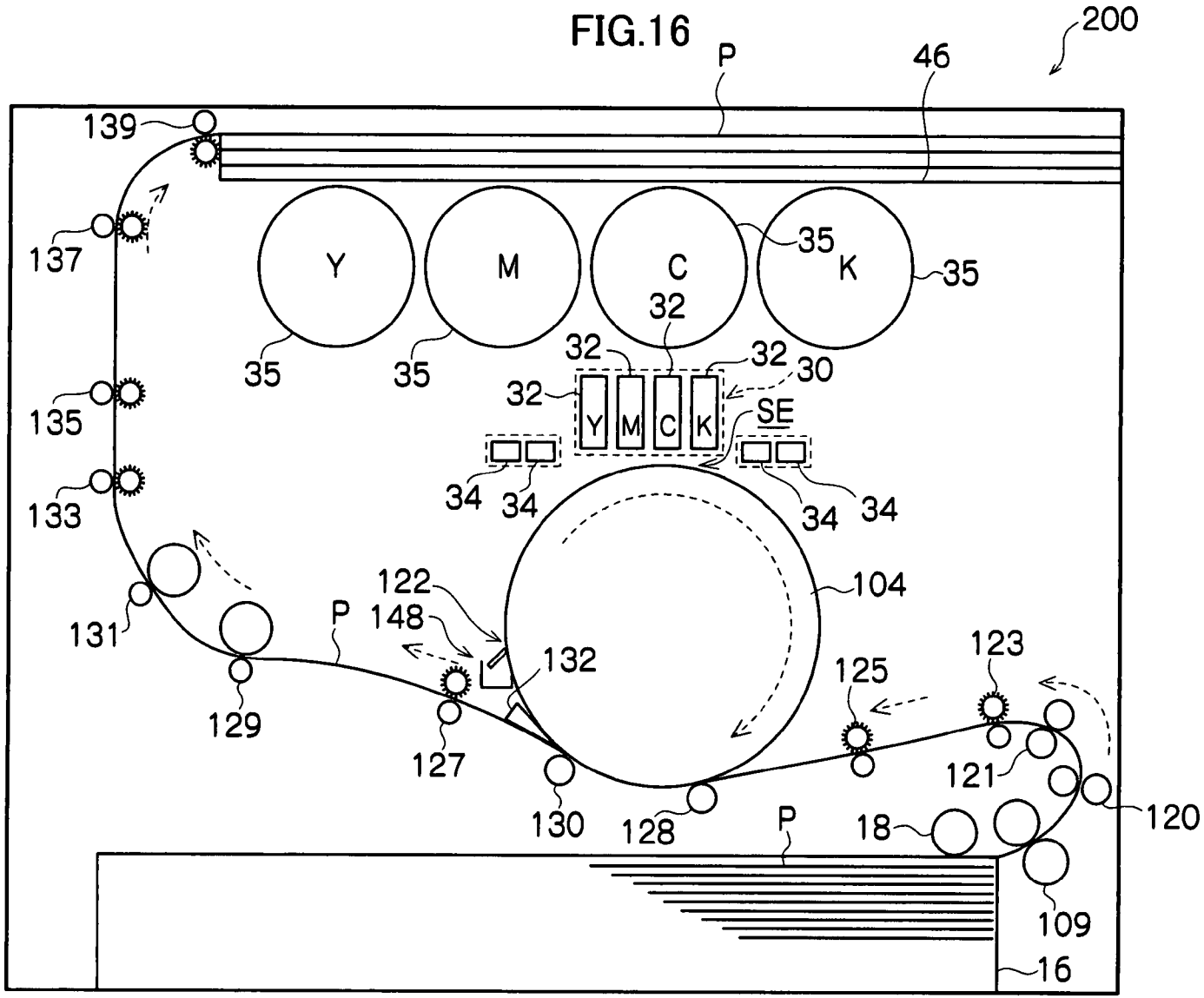
FIG. 16 is a schematic side view showing an ink jet recording device according to a third embodiment of the invention.
Figure 17:
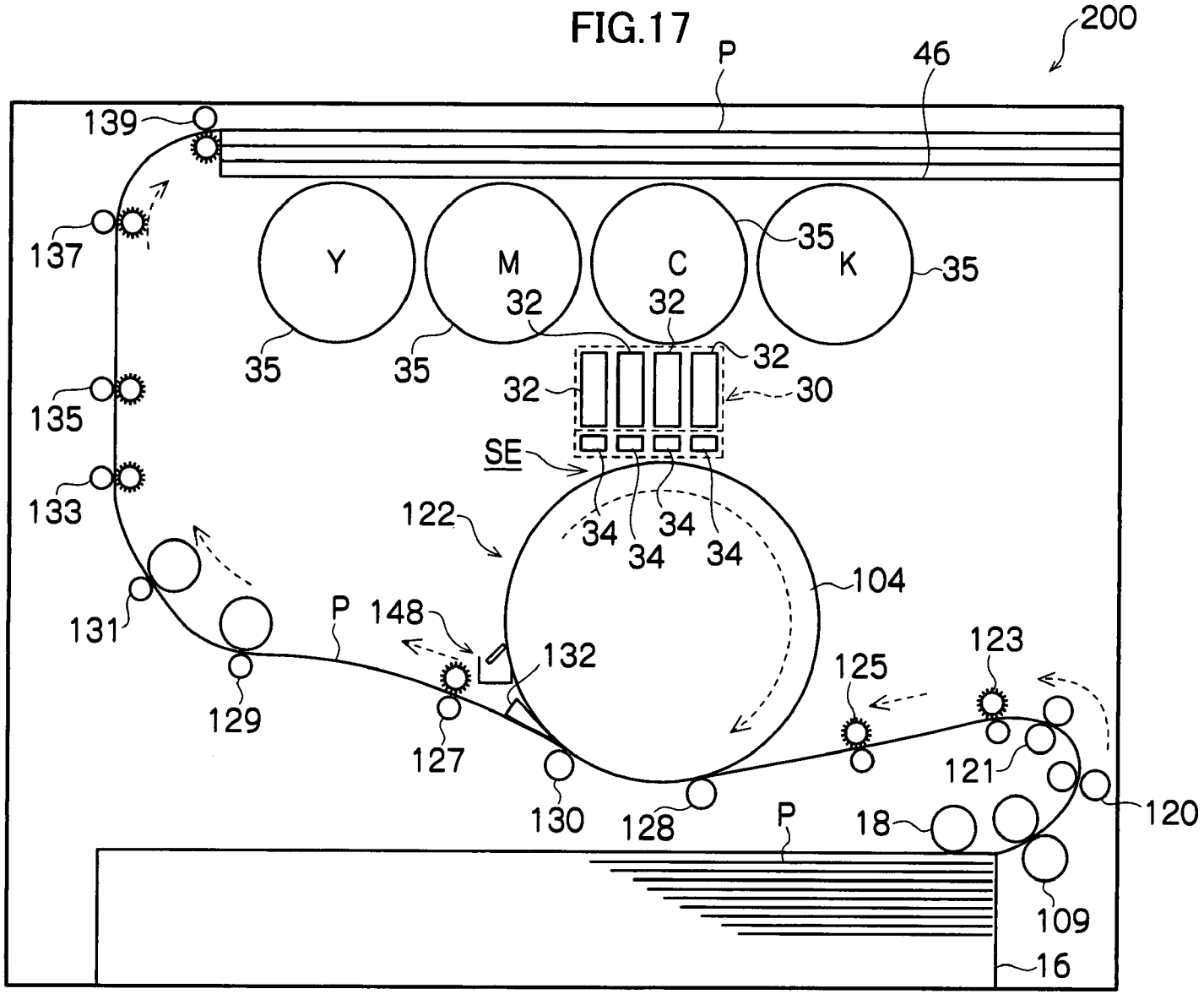
FIG. 17 is a schematic side view showing the ink jet recording device according to the third embodiment of the invention.

As shown in FIG. 16 and FIG. 17, an ink jet recording device 200 as a liquid droplet discharging device in the embodiment is a full color printer by which a full color image is formed on paper P, using ink of four colors including yellow (Y), magenta (M), black (K), and cyan (C). Moreover, the ink jet recording device 200 is a printer adopting a so-called offset printing method. According to the device 200, a recording head array 30 discharges ink toward an intermediate transfer drum 14 as an opposing member and a carrier, an ink image is temporally formed on the intermediate transfer drum 104, and the ink image is transferred from the intermediate transfer drum 104 onto paper P.

A paper feeding tray 16 is removably provided in the lowermost portion of the ink jet recording device 200. Paper P is loaded in the paper feeding tray 16, and a pick-up roller 18 abuts against the paper P at the uppermost position. Paper P is fed from the paper feeding tray 16 to the downstream side in the conveying direction by the pick-up roller 18 one by one, and, then, is fed to a printing section 122 along a conveyance path through carrying roller pairs 109, 120, 121, 123, and 125, which are sequentially disposed. Moreover, each of the fellow rollers of the carrying roller pairs 123, and 125 is a star wheel, and abuts against the surface of paper P onto which an ink image is transferred.

In the printing section 122, the intermediate transfer drum 104 is disposed, facing the conveyance path, the recording head array 30 is disposed above the intermediate transfer drum 104, and the maintenance units 34 are in close vicinity to the recording head array 30.

A recording head array 30 approaches the intermediate transfer drum 14, as shown in FIG. 16, when ink droplets are discharged. Moreover, the recording head array 30 moves away from the intermediate transfer drum 14 at maintenance as shown in FIG. 17 to secure a space, into which the maintenance units 34 enter, between the array 30 and the drum 14.

Moreover, as shown in FIG. 16, the maintenance units 34 are retracted to the outside of a discharged region SE over which ink droplets are discharged from the recording head array 30 when an image is formed. Moreover, the maintenance units 34 enter into the discharged region SE as shown in FIG. 17 when an image is not formed.

Moreover, a charging roller 128 as a transfer section, a static eliminating roller 130 as the transfer section, and a separating pawl 132 apply against the side of the conveyance path of the intermediate transfer drum 104, sequentially from the upstream side of the conveying direction as shown in FIGS. 16 and 17. The charging roller 128 presses paper P onto the intermediate transfer drum 104 for conveying, electric charges are given to the paper P which is electrostatically attracted to the drum 104, and an ink image is transferred onto the paper P. Moreover, the static eliminating roller 130 removes electric charges on the paper P, while conveying the paper P, and releases electrostatic attraction between the paper P and the intermediate transfer drum 104. Then, the separating pawl 132 separates the paper P from the intermediate transfer drum 104.

Moreover, on the downstream side of the separating pawl 132 in the carrying direction, carrying roller pairs 127, 129, 131, 133, 135, 137, and 139 are sequentially arranged from the upstream side in the conveying direction. Each of the fellow rollers of the carrying roller pairs 127, 133, 135, 137, and 139 is a star wheel, and has a smaller contact area between the surface of the paper P, onto which the ink image is transferred, and the corresponding fellow roller.

Moreover, a paper delivery tray 46 is arranged above an ink tank 35, and the carrying roller 139 is arranged on the side of the above paper delivery tray 46. That is, the paper P is delivered onto the paper delivery tray 46 through the conveying roller 139.

Figure 18:
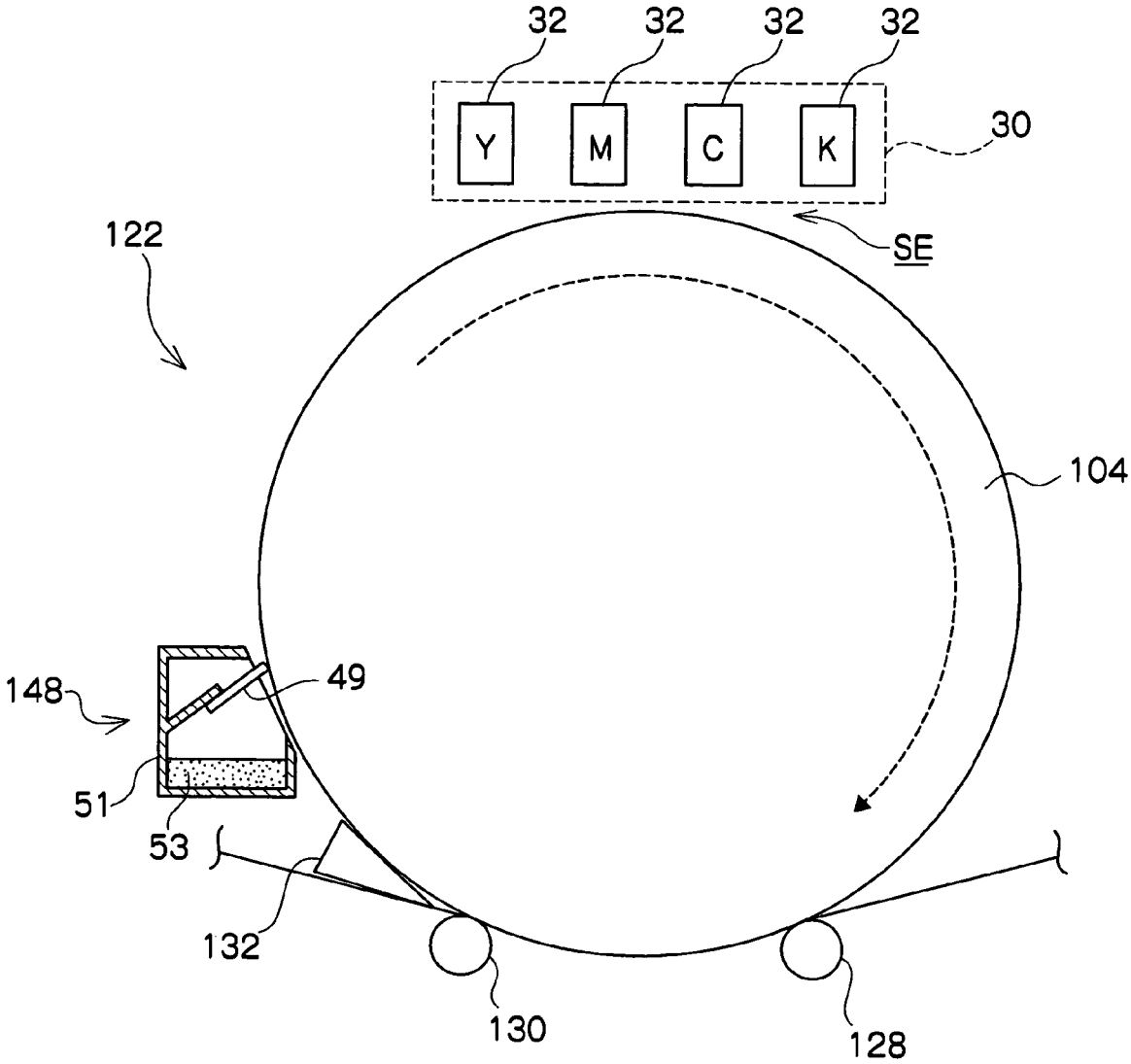
FIG. 18 is a schematic side view showing a printing section in the ink jet recording device according to the third embodiment of the invention.

As shown in FIG. 18, a drum cleaning unit 148 is arranged on the downstream side in the rotation direction of the intermediate transfer drum 14 from the separating pawl 132, and on the upstream side in the rotation direction of the intermediate transfer drum 14 from the recording head array 30. The above drum cleaning unit 148 abuts against the peripheral surface of the intermediate transfer drum 104, and is provided with a blade 49 which scrapes off ink and the like remained on the intermediate transfer drum 104 without being transferred on the paper P, and a collecting box 51 which collects ink and the like scraped off from the intermediate transfer drum 104 by the blade 49. Moreover, an absorbing body 53 is spread over the bottom of the collecting box 51, and absorbs liquid dropped from the blade 49.

Here, as the intermediate transfer drum 104 is cleaned by the blade 49 with a similar configuration to that of the first embodiment, ink scraped off from the intermediate transfer drum 104 by the blade 49 may be prevented from remaining on the blade 49, and defective cleaning of the intermediate transfer drum 104 by the blade 49 may be controlled.

Subsequently, variations of the blade 49 will be explained.

Figure 19:
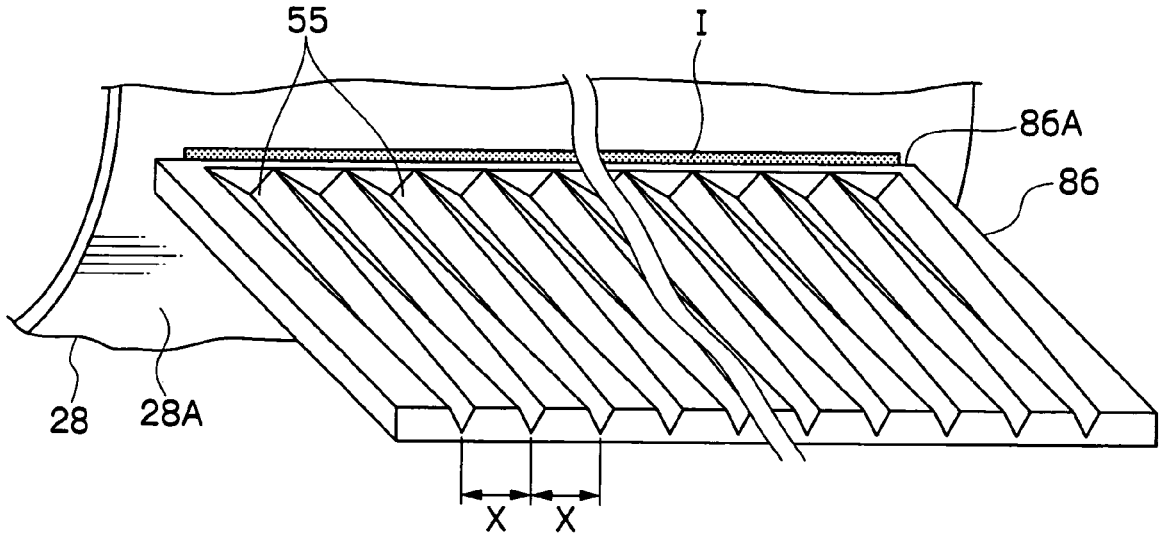
FIG. 19 is a perspective view showing a blade and a conveying belt according to a first variation.
Figure 20:
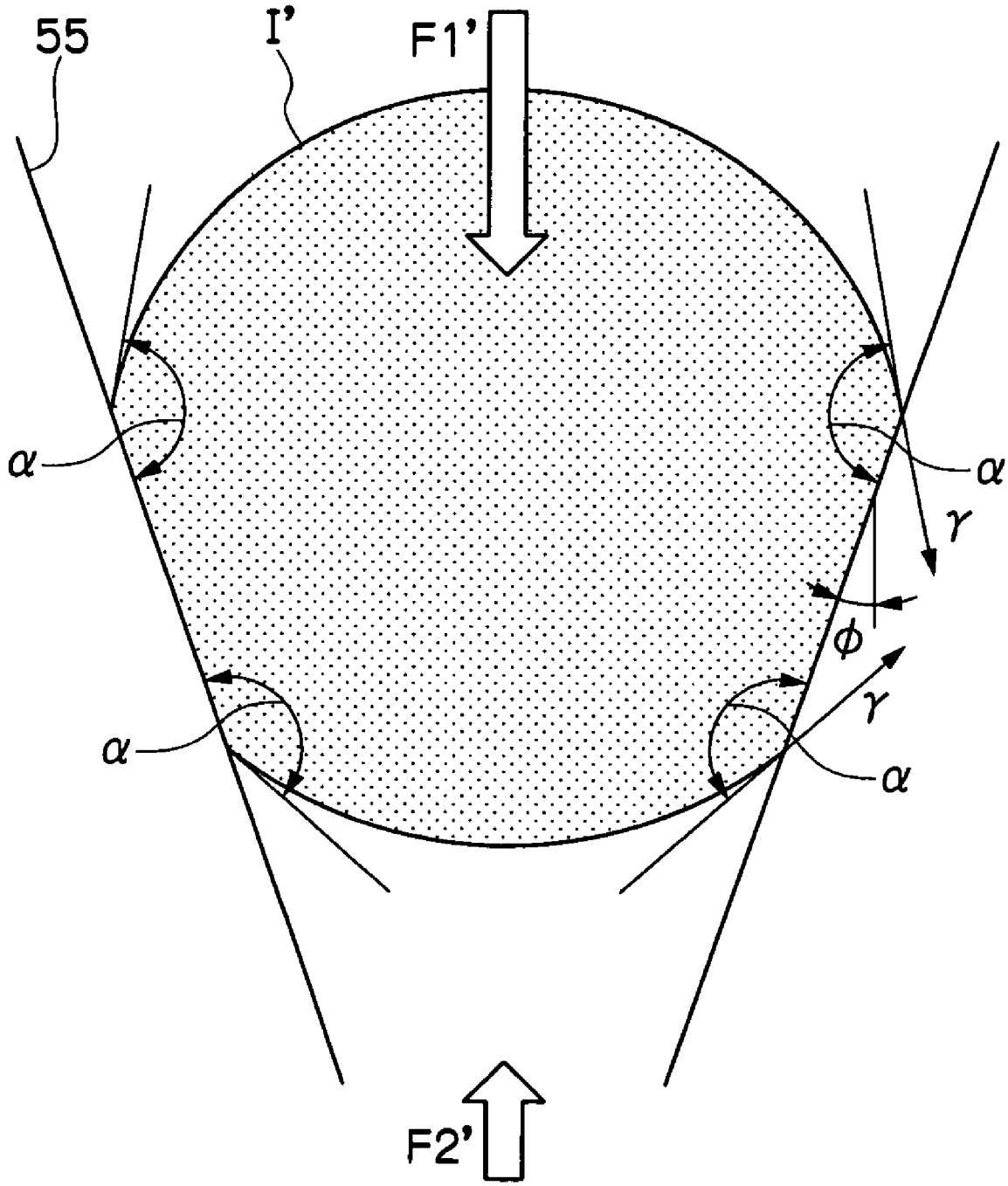
FIG. 20 is a schematic plan view showing an ink droplet flowing in a V-groove formed on the blade according to the first variation.

As shown in FIG. 19, a blade 86 according to a first variation has a similar shape to that of the blade 49, and a film with a property repelling water ink, that is, a water repellent property is formed on the wall surface of the V-groove 55. Thereby, a contact angle α between the ink droplet I' and the wall surface of the V-groove 55 becomes 90 degrees or more and 180 degrees or less as shown in FIG. 20. Accordingly, the surface shape of the ink droplet I' on the upstream side in the flow direction becomes convex in an arc shape on the upstream side, and the surface shape of the ink droplet I' on the downstream side in the flowing direction becomes convex in an arc shape on the downstream side.

Incidentally, surface tension F1' of the ink droplet I' on the upstream side in the flowing direction and surface tension F2' of the ink droplet I' on the downstream side in the flowing direction satisfy the following formulae (A') and (B'), assuming that surface tension at one point on the surface of the ink droplet I' in contact with the wall surface of the V-groove 55 is γ, a contact distance of the ink droplet I' with the wall surface of the V-groove 55 on the upstream side in the flow direction is L1, a contact distance of the ink droplet I' with the wall surface of the V-groove 55 on the downstream side in the flow direction is L2, and the downstream side of the blade 49 in the flowing direction is located downward from the upstream side.

$$F1'=-\gamma L1\cos(\alpha+\phi) \quad (A')$$

$$F2'=-\gamma L2\cos(\alpha-\phi) \quad (B')$$

Where α, ϕ, L1, and L2 satisfy the following formulae (C') and (D'):

$$\pi/2\leqq\alpha<\pi,\ 0<\phi<\pi/2 \quad (C')$$

$$L1<L2,\ L1>0,\ L2>0 \quad (D')$$

Thereby, F1'>F2' is satisfied and force (F1'−F2') from the upstream side to the downstream side in the flowing direction, in addition to the gravity, is applied to the liquid droplet T'. Accordingly, the fluidity of the ink droplet I' to the downstream side is improved as compared with a conventional configuration. Therefore, ink may be prevented from remaining on the blade 86, and defective cleaning of the conveying belt 28 by the blade 86 may be more controllable as compared with a conventional configuration.

Moreover, when many of solvents of ink are water as described in the embodiment, a material with a water repellent property, for example, fluororesin and the like may be used for the film material formed on the wall surface of the V-groove 55.

Figure 21A:
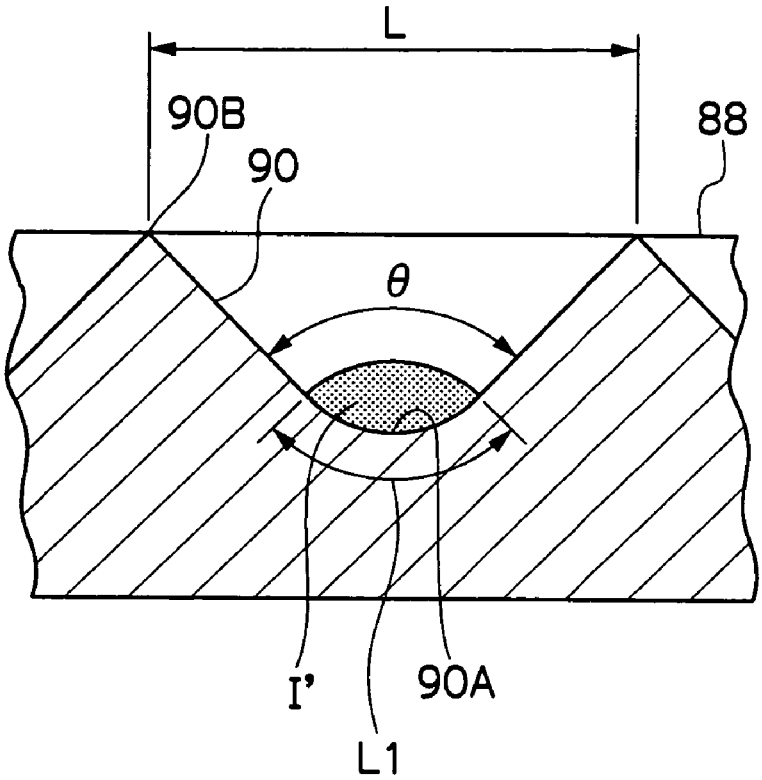
FIG. 21A is a cross sectional view showing an end portion of a blade, which is provided according to a second variation, on the upstream side in the flowing direction.
Figure 21B:
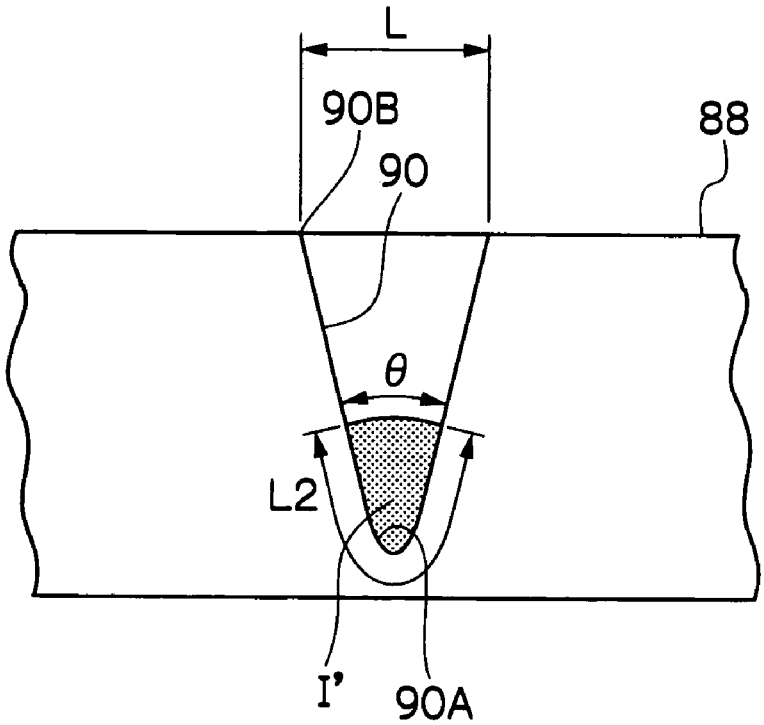
FIG. 21B is a side view showing an end portion of the blade, which is provided according to the second variation, on the downstream side in the flowing direction.

Moreover, a blade 88 according to a second variation is of a rectangular plate material, and a plurality of grooves 90, which extend from the side of the conveying belt 28 to the feed-back side of the belt 28, are formed on the blade 88, as shown in FIGS. 21A and 21B.

The above grooves 90 have a groove width increasing from a bottom portion 90A to an opening portion 90B, and the groove angle θ gradually decreasing from the side of the conveying belt 28 to the feed-back side of the belt 28.

Moreover, the bottom portion 90A of the groove 90 has a curved surface in a circular arc. Accordingly, ink may be more prevented from remaining in the bottom portion 90A as compared with a case in which there is a corner portion in the bottom portion 90A.

Figure 22A:
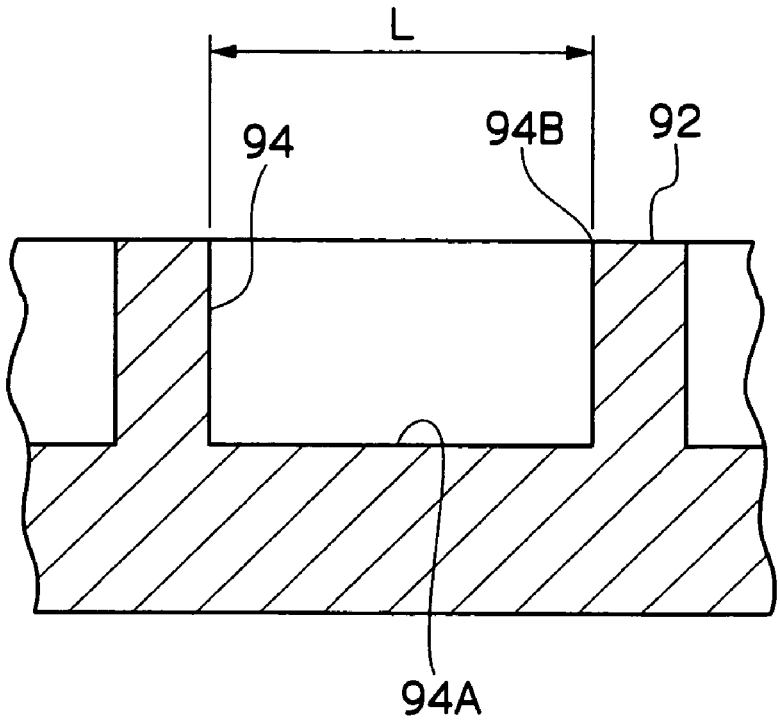
FIG. 22A is a cross sectional view showing an end portion of a blade, which is provided according to a third variation, on the upstream side in the flowing direction.
Figure 22B:
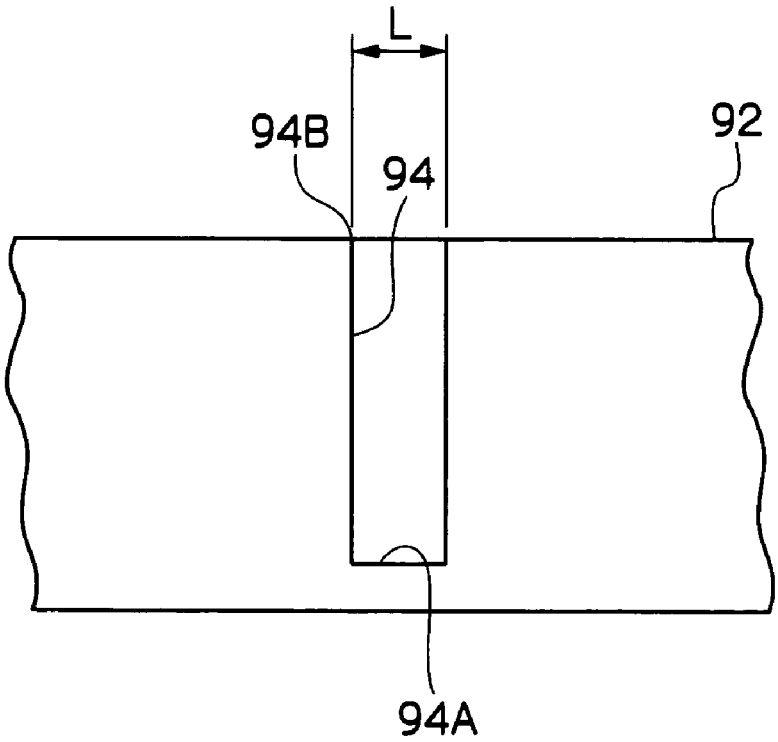
FIG. 22B is a side view showing an end portion of the blade, which is provided according to the third variation, on the downstream side in the flowing direction.

Moreover, a blade 92 as a (second) blade according to a third variation is of a rectangular plate material, and a plurality of grooves 94, which extend from the side of the conveying belt 28 to the feed-back side of the belt 28, are formed on the blade 92, as shown in FIGS. 22A and 22B. The above grooves 94 have an substantially constant groove width L from a bottom portion 94A to an opening portion 94B, and the groove width L gradually decreasing from the side of the conveying belt 28 to the feed-back side of the belt 28.

Thereby, the width of the liquid in the groove 94 in a direction perpendicular to the flowing direction of the liquid gradually decreases from the upstream side to the downstream side of the flowing direction in a similar manner to those of the first through third embodiments. Accordingly, the fluidity of the liquid from the side of the conveying belt 28 to the feed-back side of the belt 28 is improved on the blade 92 as compared with a conventional configuration. Therefore, ink may be prevented from remaining on the blade 92 as compared with a conventional configuration.

Moreover, in the first through third embodiments, the ink jet recording device has been described as one example for explaining the invention. However, the invention may be applied not only to the ink jet recording device, but to a general liquid droplet discharging device for various kinds of industrial applications such as manufacturing a color filter for display by discharging colored ink onto a polymeric film, and forming an electro-luminescent (EL) display panel by discharging organic EL solution onto a substrate.

Moreover, the "recorded medium" on which an image is recorded generally includes any materials onto which the liquid droplet discharging head may discharge liquid droplets in the liquid droplet discharging device according to the invention. Accordingly, it is obvious that recording paper, an overhead projector (OHP) sheet, and the like are used as the recorded medium, but also other materials such as a polymeric film may be used for the above object.

Moreover, the "liquid droplet discharging head" in the liquid droplet discharging device according to the invention generally includes any devices which may discharge liquid droplets toward recorded medium, a carrier, and the like. For example, an ink jet recording head, which is shorter in length than the width of paper P, and discharges ink droplets while moving in the width direction of the paper P, and the like are included.

Moreover, the "opposing member" in the liquid droplet discharging device according to the invention generally includes any members opposing to the liquid droplet discharging head. For example, a drum holding recorded medium on the peripheral surface while rotating, a rotating belt carrying liquid droplets, and the like are included.

Moreover, the "conveying member" in the liquid droplet discharging device according to the invention generally includes any type of conveying members which hold and convey recorded medium. For example, a rotating drum holding a recorded medium on the peripheral surface, a reciprocating table holding a recorded medium, and the like are included.

Moreover, the "carrier" in the liquid droplet discharging device according to the invention generally includes any types of members carrying liquid discharged from the liquid droplet discharging head. For example, a rotating belt carrying liquid droplets, and the like are included Moreover, the "cleaning section" in the liquid droplet discharging device according to the invention generally includes any types of members cleaning liquid droplets adhered to the carrier. For example, a cleaning roller which rotates in contact with the carrier, and absorbs liquid droplets, and a movable blade and the like which move in a direction intersecting with the conveying direction in contact with the carrier are included.

Moreover, the "paining member" in the liquid droplet discharging device according to the invention generally includes any members which apply coating liquid with a property, by which liquid droplets discharged from a liquid droplet discharging head are repelled, on a conveying member. For example, a liquid droplet discharging head discharging the above coating liquid toward a conveying member, a web which is impregnated with the above coating liquid, and is in contact with a conveying member, a roller holding the above coating liquid on the surface and rotating in contact with a conveying member, a roller holding the above coating liquid on the surface, and moving in a direction intersecting with the conveying direction in contact with a conveying member, and the like are included.

Moreover, the "printing section" in the liquid droplet discharging device according to the invention generally includes any sections which apply coating liquid with a property, by which liquid droplets discharged from a liquid droplet discharging head are repelled, on a carrier. For example, a liquid droplet discharging head discharging the above coating liquid toward a carrier, a web which is impregnated with the above coating liquid, and is in contact with a conveying member, a roller holding the above coating liquid on the surface and rotating in contact with a carrier, a roller holding the above coating liquid on the surface, and moving in a direction intersecting with the conveying direction in contact with a carrier, and the like are included.

It should be noted that many variations may be considered in the above described embodiments as described below.

In the liquid droplet discharging device of the first aspect of the present invention described above, the first blade cleans the opposing member opposing to the liquid droplet discharging head in contact with the opposing member. A plurality of grooves are formed on the above first blade, and the above grooves have a groove width increasing from a bottom portion to an opening portion, and liquid scraped off from the opposing member by the above first blade flows in the above grooves.

Here, as the groove angle of each groove decreases from the side of the above opposing member to the opposite side of the above opposing member, and the width of the liquid in each groove in a direction perpendicular to the flowing direction of the liquid decreases from the side of the above opposing member to the opposite side of the above opposing member, force from the side of the above opposing member to the opposite side of the above opposing member is applied onto the liquid in the groove, due to the surface tension. Thereby, the fluidity of the liquid in the groove from the side of the opposing member to the opposite side of the opposing member may be improved, liquid scraped off from the opposing member by the first blade may be prevented from remaining on the first blade, and, thereby, defective cleaning of the opposing member by the first blade may be more controllable as compared with a conventional configuration.

According to a second aspect of the present invention, the grooves may be V-grooves.

As the groove angles of a plurality of the V-grooves formed to the blade decrease from the side of the opposing member to the opposite side of the opposing member in the liquid droplet discharging device of the second aspect, force from the side of the above opposing member to the opposite side of the above opposing member is applied onto the liquid in the groove, due to the surface tension. Thereby, the fluidity of the liquid in the groove from the side of the opposing member to the opposite side of the opposing member may be improved as compared with a conventional configuration.

According to third aspect of the present invention the bottom portions of the grooves may have a curved surface.

The liquid droplet discharging device of the third aspect has a configuration in which the bottom portion of the groove with a groove width increasing from the bottom portion to the opening portion. Accordingly, the liquid may be more prevented from remaining on the bottom portion as compared with a case in which there is formed a corner portion in the bottom portion.

According to the fourth aspect of the present invention, the grooves may have an affinity for liquid discharged from the liquid droplet discharging head.

As the property of the groove includes an affinity for liquid discharged from the liquid droplet discharging head in the liquid droplet discharging device according to the fourth aspect, the surface tension of the liquid in the groove from the side of the opposing member to the opposite side of the opposing member is larger than that from the opposite side of the opposing member to the side of the opposing member. Thereby, force from the side of the opposing member to the opposite side of the opposing member is applied on the liquid in the groove.

According to the fifth aspect of the present invention, the liquid droplet discharging device may further include: a coating member which applies onto the opposing member coating liquid with a property of repelling liquid discharged from the liquid droplet discharging head, wherein the grooves have an affinity for the coating liquid.

In the liquid droplet discharging device according to the fifth aspect, coating liquid is applied on the opposing member by the coating member to form a film of the coating liquid. As the above coating liquid has a property by which liquid discharged from the liquid droplet discharging head is repelled, the liquid which has been discharged from the liquid droplet discharging head, and has been adhered to the surface of the film of the coating liquid aggregates on the film of the coating liquid. Thereby, adhering force between the liquid discharged from the liquid droplet discharging head and the opposing member is suppressed. Accordingly, when the opposing member is cleaned by the first blade, the liquid discharged from the liquid droplet discharging head and adhered to the opposing member is easily separated from the opposing member.

Here, as the groove has an affinity for the coating liquid, the surface tension of the coating liquid in the groove from the side of the opposing member to the opposite side of the opposing member is larger than that from the opposite side of the opposing member to the side of the opposing member. Thereby, force from the side of the opposing member to the opposite side of the opposing member is applied onto the coating liquid in the groove to promote flowing of the coating liquid from the side of the opposing member to the opposite side of the opposing member. Accordingly, flowing of liquid, which has been discharged from the liquid droplet discharging head, and is mixed in the coating liquid, is promoted from the side of the opposing member to the opposite side of the opposing member.

According to the sixth aspect of the present invention, the pitch of the plurality of grooves may be substantially the same as that of a plurality of liquid droplets which are generated by splitting on the blade liquid discharged from the liquid droplet discharging head.

In the liquid droplet discharging device of sixth aspect, liquid, which has been discharged from the liquid droplet discharging head, and which has been scraped off from the opposing member by the first blade, is split on the first blade to form a plurality of liquid droplets on the first blade. Here, the pitch of a plurality of liquid droplets formed on the first blade is the same as that of a plurality of the grooves. Thereby, differences in the flowing quantities of the liquid in each groove may be controlled.

According to the seventh aspect of the present invention, there may be provided a liquid droplet discharging device including: a liquid droplet discharging head, for discharging liquid droplets; an opposing member opposing the liquid droplet discharging head; and a blade, cleaning the opposing member and in contact with the opposing member, a plurality of grooves being formed on the blade, and the grooves have a groove width decreasing from the side of the opposing member to the side opposite to the opposing member.

In the liquid droplet discharging device of the seventh aspect, the blade cleans the opposing member while it is contacting with the opposing member. A plurality of grooves are formed on the blade, and liquid scraped off from the opposing member by the blade flows in the grooves.

Here, as the groove width of each groove decreases from the side of the opposing member to the side of the opposing member, and the width of the liquid in each groove in a direction perpendicular to the flowing direction of the liquid decreases from the side of the opposing member to the side of the opposing member, force from the side of the above opposing member to the opposite side of the above opposing member is applied onto the liquid in the groove, due to the surface tension. Thereby, the fluidity of the liquid in the groove from the side of the opposing member to the opposite side of the opposing member may be improved, liquid scraped off from the opposing member by the blade may be prevented from remaining on the blade, and, thereby, defective cleaning of the opposing member by the blade may be more controllable as compared with a conventional configuration.

According to the eighth aspect of the present invention the grooves have an affinity for liquid discharged from the liquid droplet discharging head.

As the property of the groove includes an affinity for liquid discharged from the liquid droplet discharging head in the liquid droplet discharging device of the eighth aspect, the surface tension of the liquid in the groove from the side of the opposing member to the opposite side of the opposing member is larger than that from the opposite side of the opposing member to the side of the opposing member. Thereby, force from the side of the above opposing member to the opposite side of the above opposing member is applied onto the liquid in the groove.

According to the ninth aspect of the present invention, the liquid droplet discharging device further includes: a coating member which applies onto the opposing member coating liquid with a property of repelling liquid discharged from the liquid droplet discharging head, wherein the grooves have an affinity for the coating liquid.

In the liquid droplet discharging device of the ninth aspect, coating liquid is applied on the opposing member by the coating member to form a film of the coating liquid. As the above coating liquid has a property by which liquid discharged from the liquid droplet discharging head is repelled, the liquid which has been discharged from the liquid droplet discharging head, and has been adhered to the surface of the film of the coating liquid aggregates on the film of the coating liquid. Thereby, adhering force between the liquid discharged from the liquid droplet discharging head and the opposing member is suppressed. Accordingly, when the opposing member is cleaned by the blade, the liquid discharged from the liquid droplet discharging head and adhered to the opposing member is easily separated from the opposing member.

Here, as the property of the groove includes an affinity for the coating liquid, the surface tension of the coating liquid in the groove from the side of the opposing member to the opposite side of the opposing member is larger than that from the opposite side of the opposing member to the side of the opposing member. Thereby, force from the side of the opposing member to the opposite side of the opposing member is applied onto the coating liquid in the groove to promote flowing of the coating liquid from the side of the opposing member to the opposite side of the opposing member. Accordingly, flowing of liquid, which has been discharged from the liquid droplet discharging head, and is mixed in the coating liquid, is promoted from the side of the opposing member to the opposite side of the opposing member.

According to the tenth aspect of the present invention, the pitch of the plurality of grooves is substantially the same as that of a plurality of liquid droplets which are generated by splitting liquid on the blade discharged from the liquid droplet discharging head.

In the liquid droplet discharging device of the tenth aspect, liquid, which has been discharged from the liquid droplet discharging head, and which has been scraped off from the opposing member by the blade, is split on the blade to form a plurality of liquid droplets on the blade. Here, the pitch of a plurality of liquid droplets formed on the blade is the same as that of a plurality of the grooves. Thereby, differences in the flowing quantities of the liquid in each groove may be controlled.

According to the eleventh aspect of the present invention the opposing member holds and conveys a recording medium with the recorded medium opposing the liquid droplet discharging head.

In the liquid droplet discharging device of the eleventh aspect, the conveying member holds recorded medium, and conveys the medium under a state in which the medium is opposing to the liquid droplet discharging head. Here, the fluidity of the liquid from the side of the conveying member to the opposite side of the conveying member may be improved on the first or the blade, which cleans the conveying member, as compared with a conventional configuration. Accordingly, defective cleaning of the conveying member by the first or blade may be more controllable as compared with a conventional configuration.

According to the twelve aspect of the present invention, the opposing member is a carrier carrying liquid droplets discharged from the liquid droplet discharging head, and having a transfer section by which the liquid droplets are transferred from the carrier to a recording medium.

In the liquid droplet discharging device of the twelve aspect, the liquid droplets discharged from the liquid droplet discharging head is carried by the carrier, and is transferred from the carrier onto the recorded medium by the transferring section. Here, the fluidity of the liquid from the side of the carrier to the opposite side of the carrier may be improved on the first or the blade, which cleans the carrier, as compared with a conventional configuration. Accordingly, defective cleaning of the conveying member by the first or blade may be more controllable as compared with a conventional configuration.

What is claimed is:

1. A liquid droplet discharging device comprising:

a liquid droplet discharging head, for discharging liquid droplets;

an opposing member, opposing the liquid droplet discharging head; and a blade, cleaning the opposing member and in contact with the opposing member, a plurality of grooves being formed on the blade, and the grooves having a groove width increasing from a bottom portion thereof to an opening portion thereof, and a groove angle decreasing from the side of the opposing member to the side opposite to the opposing member.

2. The liquid droplet discharging device of claim 1, wherein the grooves are V-grooves.

3. The liquid droplet discharging device of claim 1, wherein the bottom portions of the grooves have a curved surface.

4. The liquid droplet discharging device of claim 1, wherein a surface of the respective grooves has an affinity for liquid discharged from the liquid droplet discharging head.

5. The liquid droplet discharging device of claim 1, further comprising:

a coating member which applies onto the opposing member coating liquid with a property of repelling liquid discharged from the liquid droplet discharging head, wherein a surface of the respective grooves has an affinity for the coating liquid.

6. The liquid droplet discharging device of claim 1, wherein the pitch of the plurality of grooves is substantially the same as that of a plurality of liquid droplets which are generated by splitting on the blade liquid discharged from the liquid droplet discharging head.

7. The liquid droplet discharging device of claim 1, wherein the opposing member holds and conveys a recording medium with the recorded medium opposing the liquid droplet discharging head.

8. The liquid droplet discharging device of claim 1, wherein the opposing member is a carrier carrying liquid droplets discharged from the liquid droplet discharging head, and having a transfer section by which the liquid droplets are transferred from the carrier to a recording medium.

9. A liquid droplet discharging device comprising:

a liquid droplet discharging head, for discharging liquid droplets;

an opposing member opposing the liquid droplet discharging head; and a blade, cleaning the opposing member and in contact with the opposing member, a plurality of grooves being formed on the blade, and the grooves have a groove width decreasing from the side of the opposing member to the side opposite to the opposing member.

10. The liquid droplet discharging device of claim 9, wherein a surface of the respective grooves has an affinity for liquid discharged from the liquid droplet discharging head.

11. The liquid droplet discharging device of claim 9, further comprising:

a coating member which applies onto the opposing member coating liquid with a property of repelling liquid discharged from the liquid droplet discharging head, wherein a surface of the respective grooves has an affinity for the coating liquid.

12. The liquid droplet discharging device of claim 9, wherein the pitch of the plurality of grooves is substantially the same as that of a plurality of liquid droplets which are generated by splitting liquid on the blade discharged from the liquid droplet discharging head.

13. The liquid droplet discharging device of claim 9, wherein the opposing member holds and conveys a recording medium with the recorded medium opposing the liquid droplet discharging head.

14. The liquid droplet discharging device of claim 9, wherein the opposing member is a carrier carrying liquid droplets discharged from the liquid droplet discharging head, and having a transfer section by which the liquid droplets are transferred from the carrier to a recording medium.

* * * * *